US008562107B2

(12) United States Patent
Tamai et al.

(10) Patent No.: US 8,562,107 B2
(45) Date of Patent: Oct. 22, 2013

(54) PRINTING PROCESS OF FORMING TWO IMAGES ON PRINT MEDIUM IN OVERLAPPING MANNER

(75) Inventors: Takashi Tamai, Shiojiri (JP); Takeshi Tanoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 233 days.

(21) Appl. No.: 13/047,149

(22) Filed: Mar. 14, 2011

(65) Prior Publication Data

US 2011/0221811 A1 Sep. 15, 2011

(30) Foreign Application Priority Data

Mar. 12, 2010 (JP) ..... 2010-055423

(51) Int. Cl.
*B41J 2/145* (2006.01)

(52) U.S. Cl.
USPC ..... 347/41; 347/43; 358/2.1

(58) Field of Classification Search
USPC ..... 347/41, 43, 96, 98; 358/2.1, 3.24
See application file for complete search history.

(56) References Cited

U.S. PATENT DOCUMENTS

| | | | | |
|---|---|---|---|---|
| 6,789,867 | B2 | 9/2004 | Takahashi et al. | |
| 7,407,277 | B2 | 8/2008 | Yoneyama | |
| 2002/0063749 | A1 * | 5/2002 | Kanda et al. | 347/41 |
| 2004/0130595 | A1 * | 7/2004 | Thiessen et al. | 347/43 |
| 2004/0160478 | A1 * | 8/2004 | Weijkamp et al. | 347/43 |
| 2004/0252160 | A1 * | 12/2004 | Iwasaki et al. | 347/41 |
| 2005/0134642 | A1 * | 6/2005 | Morikawa et al. | 347/43 |
| 2006/0158481 | A1 | 7/2006 | Spevak et al. | |
| 2007/0279470 | A1 | 12/2007 | Arai | |
| 2009/0244137 | A1 | 10/2009 | Kakutani | |
| 2010/0053247 | A1 | 3/2010 | Kakutani | |
| 2011/0221810 | A1 | 9/2011 | Tamai et al. | |

FOREIGN PATENT DOCUMENTS

| | | | |
|---|---|---|---|
| CN | 101659149 | A | 3/2010 |
| JP | 2002-307672 | A | 10/2002 |
| JP | 2004-306591 | A | 11/2004 |
| JP | 2005-144749 | A | 6/2005 |

* cited by examiner

*Primary Examiner* — Julian Huffman
*Assistant Examiner* — Sharon A Polk
(74) *Attorney, Agent, or Firm* — Nutter McClennen & Fish LLP; John J. Penny, Jr.

(57) ABSTRACT

The printing apparatus includes a control-section for forming an image on a print-medium by repeating an image-formation-operation and a transport-operation. Through the image-formation-operation, a plurality of nozzle-arrays discharges an ink while a moving-mechanism moves the plurality of nozzle-arrays, and through the transport-operation, the print-medium is transported to the transport-mechanism. The control-section forms a first-image by using a nozzle group for the first-image. The nozzle-group for the first-image is formed of N nozzles included in a first-nozzle-array of the plurality of nozzle-arrays. In addition, the control-section forms a second-image, which overlaps with the first-image on the print-medium, by using a nozzle-group for the second-image. The nozzle-group for the second-image is formed of M nozzles among the nozzles included in the second-nozzle-array of the plurality of nozzle-arrays, and the position of the nozzle-group for the second-image is different from that of the nozzle-group for the first-image in a first-direction.

10 Claims, 26 Drawing Sheets

WHITE-COLOR PRINTING (W-C PRINTING)

COLOR-WHITE PRINTING (C-W PRINTING)

FIRST EMBODIMENT

MODE A1 (IMAGE QUALITY PRIORITY)

FIRST EMBODIMENT
MODE B1
(BALANCE BETWEEN IMAGE QUALITY AND PRINTING SPEED)

FIRST EMBODIMENT
MODE C1 (PRINTING SPEED PRIORITY)

SECOND EMBODIMENT
MODE A2 (IMAGE QUALITY PRIORITY)

SECOND EMBODIMENT
MODE B2
(BALANCE BETWEEN IMAGE QUALITY AND PRINTING SPEED)

SECOND EMBODIMENT
MODE C2 (PRINTING SPEED PRIORITY)

THIRD EMBODIMENT
MODE A3 (IMAGE QUALITY PRIORITY)

THIRD EMBODIMENT
MODE C3 (PRINTING SPEED PRIORITY)

FOURTH EMBODIMENT
MODE A4 (IMAGE QUALITY PRIORITY)

FOURTH EMBODIMENT
MODE C4 (PRINTING SPEED PRIORITY)

FIFTH EMBODIMENT
MODE A5 (IMAGE QUALITY PRIORITY)

FIFTH EMBODIMENT
MODE C5 (PRINTING SPEED PRIORITY)

SIXTH EMBODIMENT
MODE A6 (IMAGE QUALITY PRIORITY)

SIXTH EMBODIMENT
MODE C6 (PRINTING SPEED PRIORITY)

SEVENTH EMBODIMENT
MODE A7 (IMAGE QUALITY PRIORITY)

SEVENTH EMBODIMENT
MODE C7 (PRINTING SPEED PRIORITY)

EIGHTH EMBODIMENT
MODE A8 (IMAGE QUALITY PRIORITY)

EIGHTH EMBODIMENT
MODE C8 (PRINTING SPEED PRIORITY)

PRINTING PROCESS OF FORMING TWO IMAGES ON PRINT MEDIUM IN OVERLAPPING MANNER

BACKGROUND

1. Technical Field

The present invention relates to a printing process of forming two images on a print medium in an overlapping manner.

2. Related Art

There have been known printing apparatuses including an image recording head, which discharges an image recording ink for mainly recording an image, and an auxiliary recording head which is disposed upstream and/or downstream of the image recording head in a sub-scanning direction thereof and discharges an auxiliary recording ink, such as an ink for background or a transparent ink, for supplementing the image recording (for example, refer to JP-A-2005-144749). Such printing apparatuses are able to form two images (for example, a white background image and a color image) on a print medium (for example, a transparent film) in an overlapping manner. In addition, JP-A-2002-307672 is an example of the related art.

In the printing apparatuses of the related art, apart from the image recording head, there is provided an auxiliary recording head which is disposed upstream and/or downstream thereof in the sub-scanning direction. For this reason, a problem arises in that there is an increase in the size of the apparatus for performing the printing process of forming two images on a print medium in an overlapping manner.

On the other hand, when the printing process of forming two images on a print medium in an overlapping manner is intended to be performed, in accordance with the uses and purposes thereof, different image qualities may be necessary for the respective two images. Hence, it is preferable to achieve a printing process appropriate for the use and purpose, for example, a printing process in which image quality of one image is set to have priority over that of the other.

SUMMARY

An advantage of some aspects of the invention is to achieve a printing process appropriate for the use and purpose while suppressing an increase in size of the printing apparatus when performing the printing process of forming two images on a print medium in an overlapping manner.

In order to solve at least a part of the above problems, the invention can be implemented as the following aspects or applications.

Application 1

According to an aspect of the invention, a printing apparatus includes: a plurality of nozzle arrays that is formed of a plurality of nozzles which is arranged along a first direction so as to discharge an ink, respectively corresponds to different inks, the plurality of nozzle arrays being arranged along a second direction intersecting with the first direction; a moving mechanism that relatively moves the plurality of nozzle arrays relative to a print medium in the second direction; a transport mechanism that transports the print medium relative to the plurality of nozzle arrays in the first direction; and a control section that forms an image on the print medium by repeating an image formation operation for discharging an ink through the plurality of nozzle arrays while allowing the moving mechanism to move the plurality of nozzle arrays and a transport operation for transporting the print medium through the transport mechanism. The control section forms a first image by using a nozzle group for the first image. The nozzle group for the first image is formed of N (N is an integer equal to or more than 3) nozzles included in a first nozzle array of the plurality of nozzle arrays. In addition, the control section forms a second image, at least a part of which overlaps with the first image on the print medium, by using a nozzle group for the second image. The nozzle group for the second image is formed of M (M is an integer equal to or more than 2 and less than N) nozzles among the nozzles included in the second nozzle array of the plurality of nozzle arrays, and the position of the nozzle group for the second image is different from that of the nozzle group for the first image in a first direction.

In the printing apparatus, by using the nozzle group for the first image in the first nozzle array, the first image is formed, and by using the nozzle group for the second image which has a position different from that of the nozzle group for the first image in the first direction in the second nozzle array, the second image at least a part of which overlaps with the first image is formed on the print medium. Thus, it is possible to achieve a printing process of concurrently forming the first image and the second image while suppressing an increase in the size of the apparatus. Further, in the printing apparatus, the number of nozzles, which constitute the nozzle group for the first image used to form the first image, is larger than the number of nozzles which constitute the nozzle group for the second image used to form the second image. Hence, it is possible to reduce the entire printing time while suppressing deterioration in image quality of the first image. As a result, it is possible to achieve a printing process appropriate for the use and purpose thereof.

Application 2

In the printing apparatus according to Application 1, it is preferable that the control section should form the first image and the second image through a printing mode, in which the first image is formed by using the nozzle group for the first image formed of the N nozzles and the second image is formed by using the nozzle group for the second image formed of the M nozzles, and a printing mode in which the first image is formed by using the nozzle group for the first image, which is formed of L (L is an integer equal to or more than 2) nozzles included in the first nozzle array, the second image is formed by using the nozzle group for the second image, which is formed of L nozzles among the nozzles included in the second nozzle array, and the position of the nozzle group for the second image is different from that of the nozzle group for the first image in the first direction.

The printing apparatus is able to form an image through a printing mode in which the number of nozzles, which constitute the nozzle group for the first image used to form the first image, is the same as the number of nozzles which constitute the nozzle group for the second image used to form the second image. Hence, it is possible to selectively perform, in accordance with the purpose and use thereof, a printing process capable of suppressing deterioration in image quality of both of the first image and the second image or a printing process capable of reducing the printing time while suppressing deterioration in image quality of the first image. As a result, it is possible to achieve a printing process appropriate for the use and purpose thereof.

Application 3

In the printing apparatus according to Application 1 or Application 2, it is preferable that the control section should form the first image and the second image through a plurality of printing modes of which respective ratios of N to M are different from each other.

The printing apparatus is able to form an image through the plurality of printing modes each of which has mutually different ratios of the number of nozzles N, which constitute the nozzle group for the first image used to form the first image, to the number of nozzles M which constitute the nozzle group for the second image used to form the second image. Hence, it is possible to selectively perform, in accordance with the purpose and use thereof, a printing process which has different balances between reduction in printing time and deterioration in image quality of the second image. As a result, it is possible to achieve a printing process appropriate for the use and purpose thereof.

Application 4

In the printing apparatus according to Application 1, it is preferable that the control section should allow the number of the image formation operations, which are performed to form an area having a predetermined width in the first direction in the first image, to be larger than the number of the image formation operations which are performed to form the area having the predetermined width in the first direction in the second image.

In the printing apparatus, the number of nozzles, which constitute the nozzle group for the first image used to form the first image, is set to be larger than the number of nozzles which constitute the nozzle group for the second image used to form the second image. Thus, it is possible to reduce the entire printing time while suppressing deterioration in image quality of the first image. As a result, it is possible to achieve a printing process appropriate for the use and purpose thereof.

Application 5

In the printing apparatus according to Application 1, it is preferable that the control section should allow a print resolution of the first image, which is formed on the print medium, in at least one of the first direction and the second direction to be finer than a print resolution of the second image, which is formed on the print medium, corresponding thereto.

In the printing apparatus, the number of nozzles, which constitute the nozzle group for the first image used to form the first image, is set to be larger than the number of nozzles which constitute the nozzle group for the second image used to form the second image. In such a manner, it is possible to reduce the entire printing time while suppressing deterioration in image quality of the first image. As a result, it is possible to achieve a printing process appropriate for the use and purpose thereof.

Application 6

In the printing apparatus according to Application 1, it is preferable that the control section should allow the number of the nozzles, which are used to form one ink dot line along the second direction in the first image, to be larger than the number of the nozzles which are used to form one ink dot line along the second direction in the second image.

In the printing apparatus, the number of nozzles, which constitute the nozzle group for the first image used to form the first image, is set to be larger than the number of nozzles which constitute the nozzle group for the second image used to form the second image. In such a manner, it is possible to reduce the entire printing time while suppressing deterioration in image quality of the first image. As a result, it is possible to achieve a printing process appropriate for the use and purpose thereof.

Application 7

In the printing apparatus according to any one of Applications 1 to 6, it is preferable that the control section should acquire dot data which respectively corresponds to two images and represents ink dots to be formed, form the first image by using the nozzle group for the first image on the basis of the dot data in which the number of the ink dots to be formed is larger, and form the second image by using the nozzle group for the second image on the basis of the dot data in which the number of the ink dots to be formed is smaller.

In the printing apparatus, the image quality of the image, which has a small number of ink dots to be formed, is set to be lower than the image quality of the image which has a large number of ink dots to be formed. In such a manner, it is possible to reduce the printing time, and thus it is possible to achieve a printing process appropriate for the use and purpose thereof.

Application 8

In the printing apparatus according to Application 1, it is preferable that the control section should form the second image by using the nozzle group for the second image and at least one nozzle, of which a position is different from the positions of the nozzle group for the first image and the nozzle group for the second image in the first direction, among the nozzles included in the second nozzle array.

In the printing apparatus, when the printing time is reduced by lowering the image quality of the second image, it is possible to suppress deterioration of image quality of the second image.

Application 9

In the printing apparatus according to Application 1, it is preferable that the control section should form the second image by using the nozzle group for the second image and a nozzle group of which a position is the same as that of the nozzle group for the second image in the first direction among the nozzles included in the first nozzle array.

The printing apparatus is able to form the second image by using the nozzle group included in the first nozzle array in addition to the nozzle group included in the second nozzle array. Accordingly, when performing the printing process of forming various types of two images in an overlapping manner, it is possible to achieve a printing process appropriate for the use and purpose thereof while suppressing an increase in the size of the apparatus.

In addition, the invention may be implemented as various aspects, and for example, may be implemented in a mode of a printing method and apparatus, a control method and a control device of the printing apparatus, a printing system, a computer program for executing the functions of these methods, apparatuses and systems, a recording medium storing the computer program, or a data signal including the computer program and embodied in a carrier wave.

DESCRIPTION OF EXEMPLARY EMBODIMENTS

Next, embodiments of the invention will be described in the following order.

A. First Embodiment
A-1. Configuration of Printing System
A-2. Printing Process
A-3. Printing Mode
B. Second Embodiment
C. Third Embodiment
D. Fourth Embodiment
E. Fifth Embodiment
F. Sixth Embodiment
G. Seventh Embodiment
H. Eighth Embodiment
I. Modified Example

A. First Embodiment

A-1. Configuration of Printing System

Figure 1:
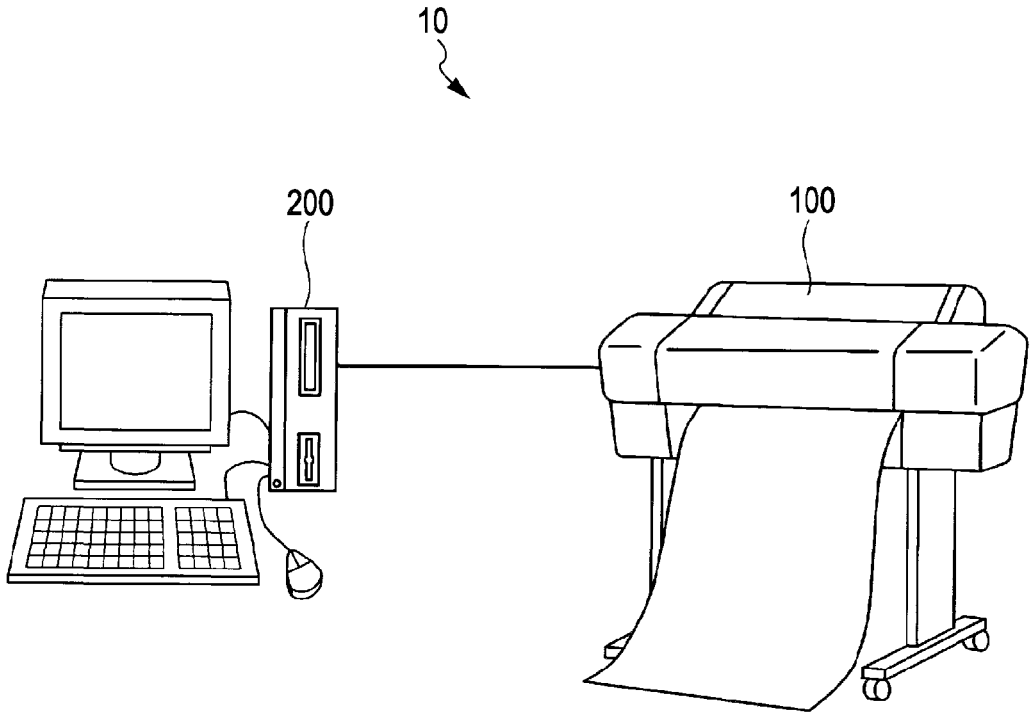
FIG. 1 is an explanatory diagram schematically illustrating a configuration of a printing system according to a first embodiment of the invention.

FIG. 1 is an explanatory diagram schematically illustrating the configuration of the printing system according to the first embodiment of the invention. The printing system 10 according to the present embodiment includes a printer 100 and a personal computer (PC) 200. The printer 100 is a color printer of an ink jet type which prints an image by ejecting ink so as to form ink dots on a print medium (for example, a printing sheet or a transparent film). The PC 200 functions as a print control apparatus capable of supplying print data to the printer 100 and controlling a printing operation of the printer 100. The printer 100 is connected to the PC 200 in a wired or wireless manner to exchange information. In detail, in the embodiment, the printer 100 is connected to the PC 200 through a USB cable.

The printer 100 of the embodiment is a printer that performs printing by using inks of a total of five colors including cyan (C), magenta (M), yellow (Y), black (K), and white (W). The printing system 10 of the embodiment performs a printing process of concurrently forming a color image and a white image on a transparent film as a print medium. The transparent film, on which the color image and the white image are formed, for example, is used as a film for packaging a product.

In the present specification, adjusting a color by mixing a white ink with an ink of a different color will be referred to as "white toning". Further, a white color (an adjusted white color) generated by the white toning will be referred to as a "toned white color", and an image formed by a toned white color will be referred to as a "toned white image". The above-mentioned "white image" is defined to include not only a (pure) white image, which is formed by using only the white ink, but also the toned white image.

Further, in the specification, the "white color", for example, is defined to include: (1) a color existing in a circle having a radius of 20 on an a*b* plane in a Lab color system and in the inner side of the circle, and existing within a hue range in which L* is 70 or more as a result of color measurement under conditions in which the eye-one Pro manufactured by X-Rite Corp. is used as a colorimeter, a color measurement mode is spot color measurement, a light source is D50, backing is black and a print medium is a transparent film; (2) a color existing in a circle having a radius of 20 on an a*b* plane in a Lab color system and in the inner side of the circle, and existing within a hue range in which L* is 70 or more as a result of color measurement in a white background under conditions in which CM2022 manufactured by Minolta Corp. is used as a colorimeter, a measurement mode is an SCF mode, and a field of vision is D502°; and (3) a color of ink used as a background of an image as disclosed in JP-A-2004-306591. Accordingly, the white color is not limited to the pure white color.

Figure 2:
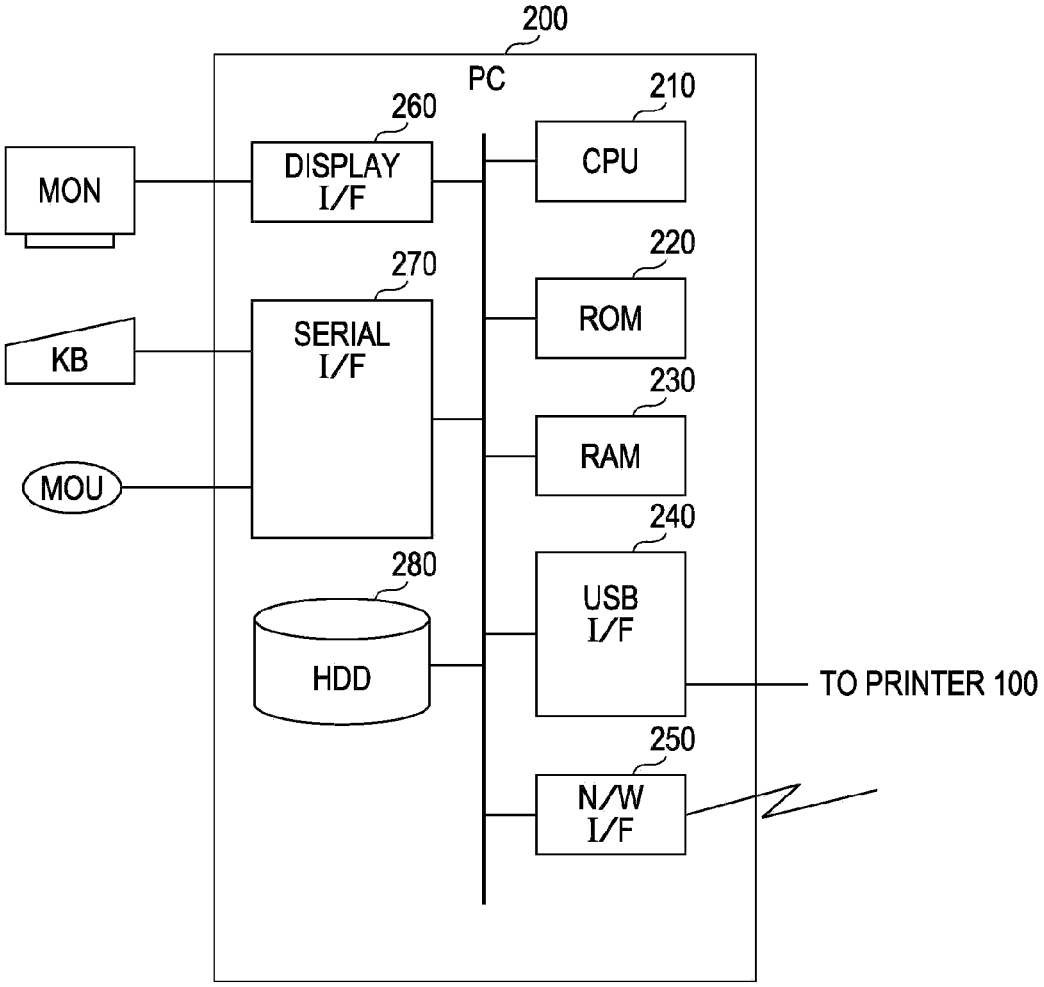
FIG. 2 is an explanatory diagram schematically illustrating a configuration of a PC.

FIG. 2 is an explanatory diagram schematically illustrating the configuration of the PC 200. The PC 200 includes a CPU 210, a ROM 220, a RAM 230, a USB interface (USB I/F) 240, a network interface (N/W I/F) 250, a display interface (display I/F) 260, a serial interface (serial I/F) 270, and a hard disk drive (HDD) 280. All constituent elements of the PC 200 are connected to each other through a bus.

The PC 200 is connected to the printer 100 through the USB interface 240. The display interface 260 is connected to a monitor MON serving as a display device. The serial interface 270 is connected to a keyboard KB and a mouse MOU serving as input devices. Further, the configuration of the PC 200 shown in FIG. 2 is just one example, and may be modified so that some constituent elements of the PC 200 are omitted or a new constituent element is added to the PC 200.

Figure 3:
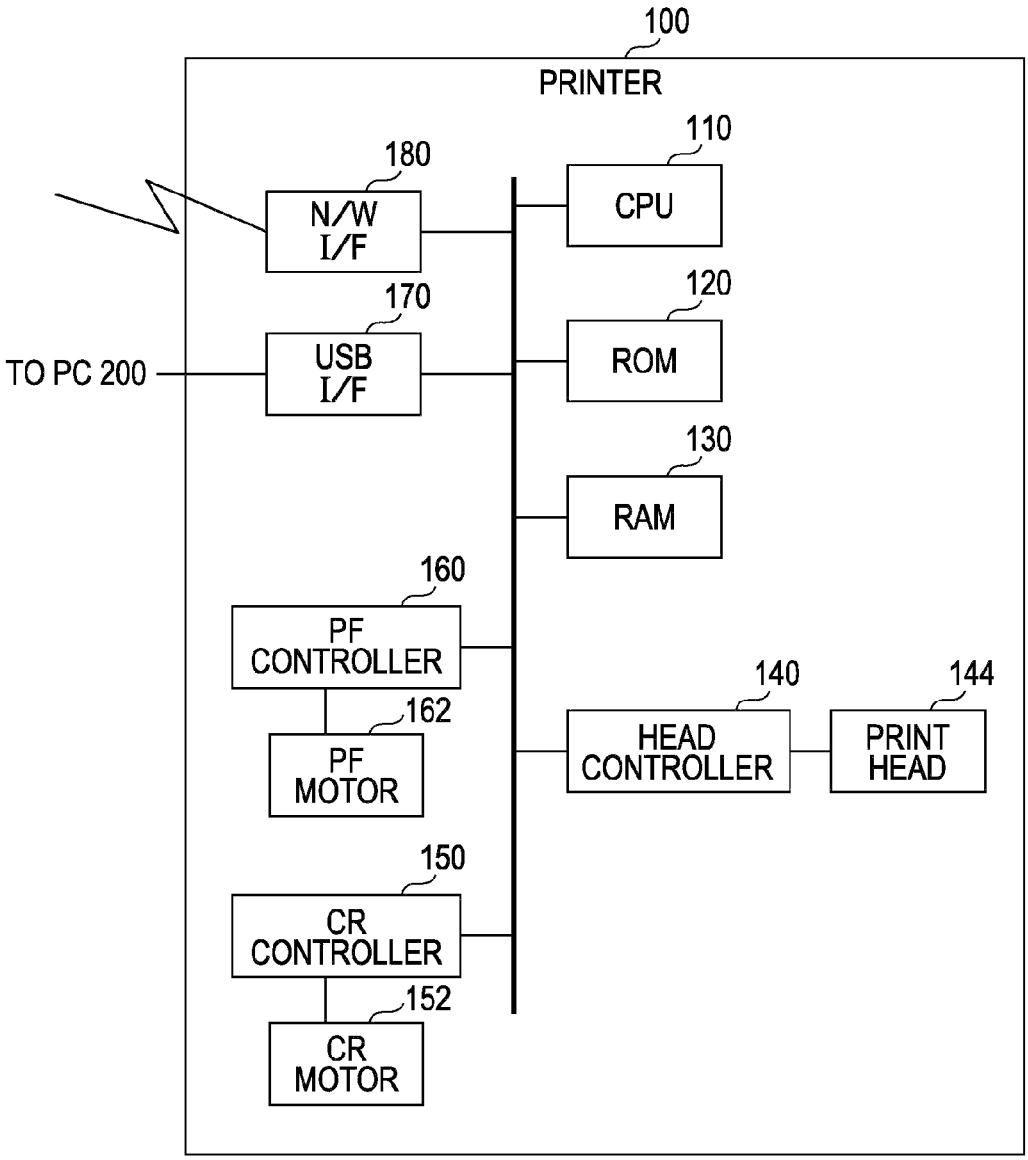
FIG. 3 is an explanatory diagram schematically illustrating a configuration of a printer.

FIG. 3 is an explanatory diagram schematically illustrating the configuration of the printer 100. The printer 100 includes a CPU 110, a ROM 120, a RAM 130, a head controller 140, a print head 144, a carriage controller (CR controller) 150, a carriage motor (CR motor) 152, a print medium feeding controller (PF controller) 160, a print medium feeding motor (PF motor) 162, a USB interface (USB I/F) 170 and a network interface (N/W I/F) 180. The constituent elements of the printer 100 are connected to each other through a bus.

The CPU 110 of the printer 100 functions as a control unit that controls the entire operation of the printer 100 by executing computer programs stored in the ROM 120. The print head 144 of the printer 100 includes a plurality of nozzle arrays corresponding to the respective ink colors.

Figure 4:
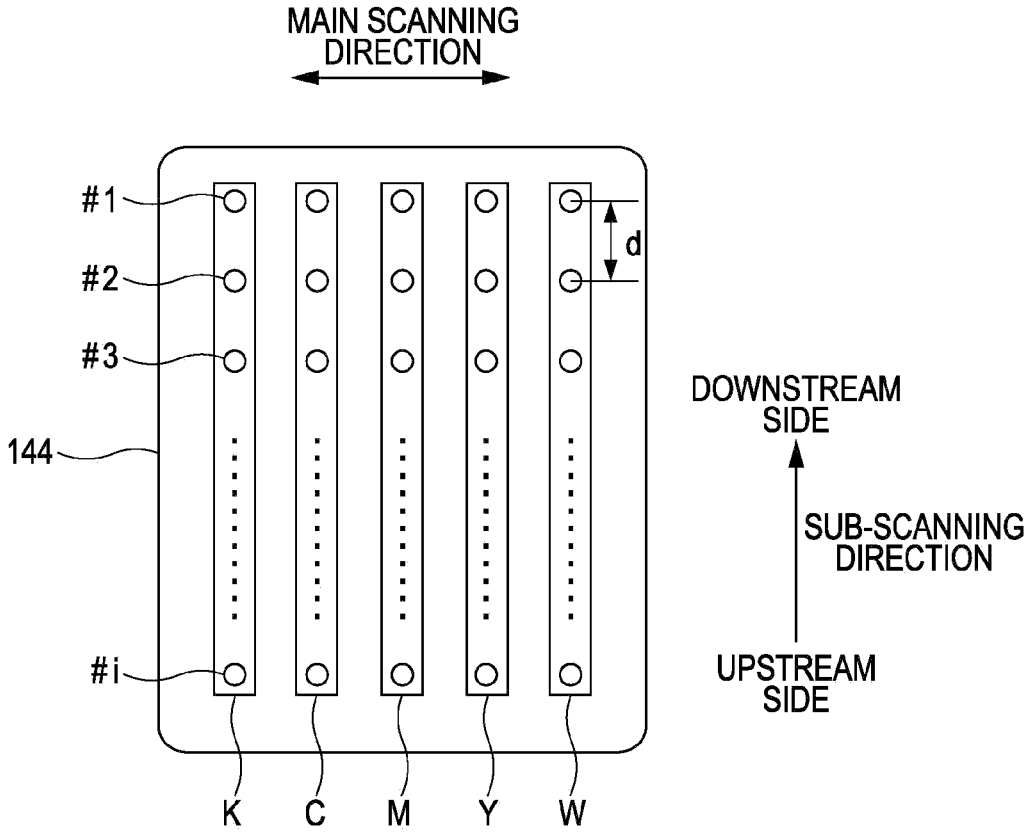
FIG. 4 is an explanatory diagram illustrating a configuration of a print head.

FIG. 4 is an explanatory diagram illustrating a configuration of the print head 144. The print head 144 of the embodiment has five nozzle arrays respectively corresponding to five inks. The five nozzle arrays are arranged side by side on one surface of the print head 144 along a main scanning direction (which will be described later). Each nozzle array is formed of plural (i) nozzles which are arranged with a pitch d along a sub-scanning direction (which will be described later).

The print head 144 (FIG. 3) is mounted on a carriage which is not shown. The carriage controller 150 controls the carriage motor 152 such that it reciprocates the carriage in a predetermined direction (the main scanning direction). Thereby, main scanning is performed in a way that the print head 144 reciprocates in the main scanning direction relative to a print medium. Further, the print medium feeding controller 160 controls the print medium feeding motor 162 such that it performs sub-scanning for transporting the print medium in a direction (the sub-scanning direction) substantially orthogonal to the main scanning direction. The head controller 140 controls ink ejection from the nozzles of the print head 144. The CPU 110 controls the respective units of the printer 100 such that they repeatedly perform the image formation operation (hereinafter, referred to as "printing pass"), which discharges an ink during the main scanning, and the sub-scanning, thereby forming (printing) an image on a print medium. In addition, the main scanning direction corresponds to the second direction in the embodiment of the invention; the sub-scanning direction corresponds to the first direction in the embodiment of the invention.

Figure 5:
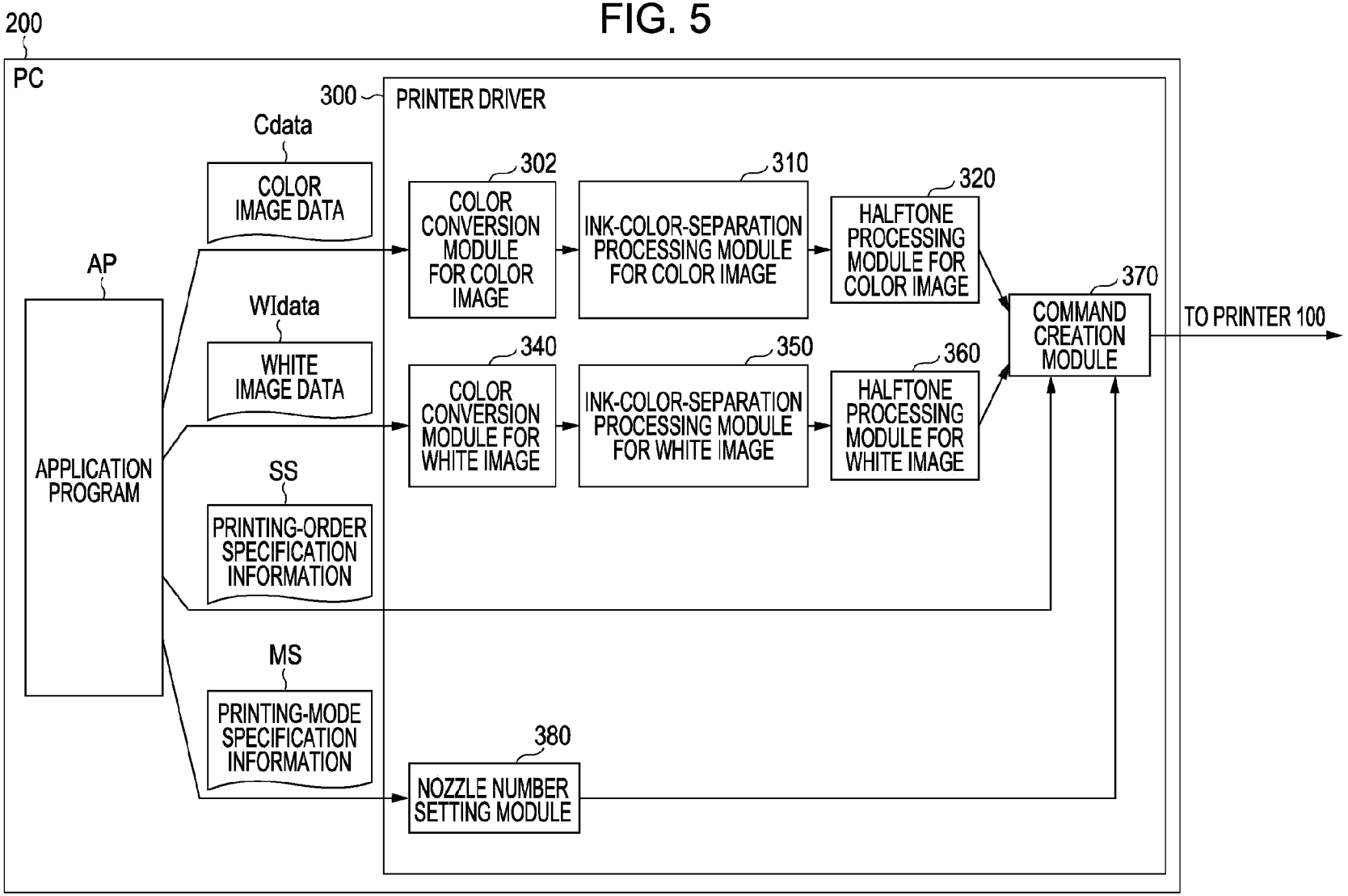
FIG. 5 is a block diagram functionally illustrating a configuration of a PC.

FIG. 5 is a block diagram functionally illustrating the configuration of the PC 200. The ROM 220 (FIG. 2) of the PC 200 stores an application program AP and a printer driver 300 as the computer programs executed by the CPU 210. The application program AP is used for generating and editing an image (hereinafter, referred to as a "print image PI") to be printed on a transparent film as the print medium. The CPU 210 generates and edits the print image PI by executing the application program AP.

Further, the CPU 210 executing the application program AP outputs color image data Cdata, white image data WIdata, printing-order specification information SS, and printing-mode specification information MS to the printer driver 300 in response to a print execution instruction from a user. The contents of each piece of data will be described in detail in "A-2. Printing Process".

The printer driver 300 is a program for controlling the printer 100 (FIG. 1) such that it prints the print image PI. The CPU 210 (FIG. 2) of the PC 200 executes the printer driver 300, thereby controlling the printer 100 such that it prints the print image PI.

As shown in FIG. 5, the printer driver 300 includes a color conversion module 302 for color image, an ink-color-separation processing module 310 for color image, a halftone processing module 320 for color image, a color conversion module 340 for white image, an ink-color-separation processing module 350 for white image, a halftone processing module 360 for white image, a nozzle number setting module 380 and a command creation module 370. The functions of the modules will be described in "A-2. Printing Process".

Figure 6:
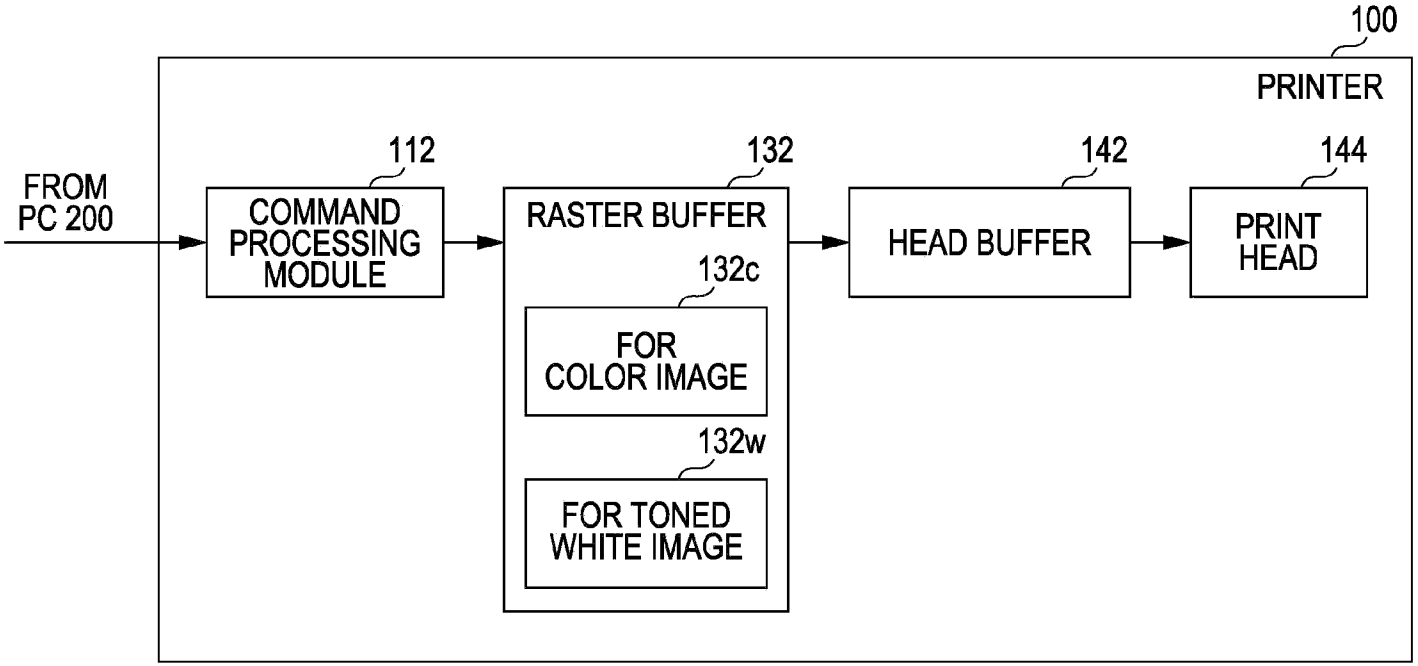
FIG. 6 is a block diagram functionally illustrating a configuration of the printer.

FIG. 6 is a block diagram functionally illustrating the configuration of the printer 100. The ROM 120 (FIG. 3) of the printer 100 stores a command processing module 112 serving as a computer program executed by the CPU 110. The CPU 110 executes a command received from the PC 200 by executing the command processing module 112. Further, the RAM 130 (FIG. 3) of the printer 100 includes a raster buffer 132. The raster buffer 132 includes two areas of a raster buffer 132*c* for color image and a raster buffer 132*w* for white image. In addition, the head controller 140 (FIG. 3) of the printer 100 includes a head buffer 142. The functions of the program and buffer will be described in detail in "A-2. Printing Process".

A-2. Printing Process

Figure 7A:
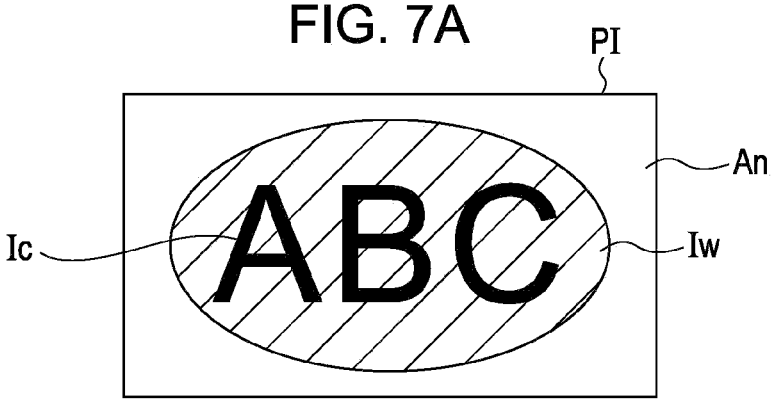
FIGS. 7A to 7C are explanatory diagrams illustrating examples of print images which are formed by a printing process in a printing system according to the first embodiment.
Figure 7B:
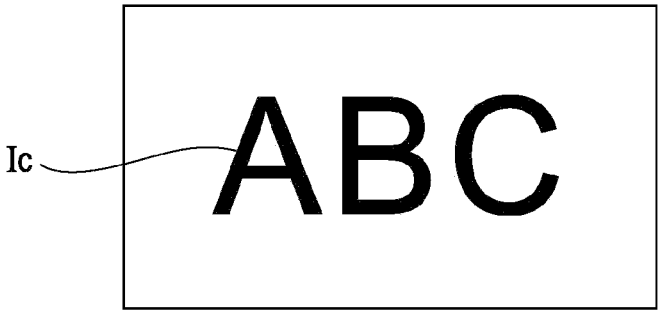
Figure 7C:
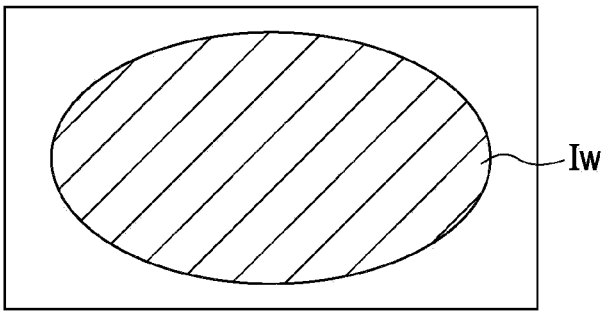

FIGS. 7A to 7C are explanatory diagrams illustrating examples of print images which are formed by the printing process in the printing system 10 according to the embodiment. As shown in FIG. 7A, the print image PI is an image, which is printed by forming the color image Ic (an image of "ABC" in the drawing) shown in FIG. 7B and the white image Iw shown in FIG. 7C in an overlapping manner. Further, in the print image PI, an area, in which both of the color image Ic and the white image Iw are formed, is referred to as a non-printed area An. In the printing process of the embodiment, a transparent film is used as the print medium, and thus the non-printed area An is a transparent area. The color image Ic corresponds to the first image in the embodiment of the invention, and the white image Iw corresponds to the second image in the embodiment of the invention.

The printing process is started when the CPU 210 (FIG. 2) of the PC 200, which executes an application program AP (FIG. 5), receives a print execution instruction from a user. The CPU 210 outputs the color image data Cdata, the white image data WIdata, the printing-order specification information SS, and the printing-mode specification information MS to the printer driver 300 in response to the reception of the print execution instruction (refer to FIG. 5).

The color image data Cdata is data which specifies the color image Ic in the print image PI. Specifically, the color image data Cdata is data that specifies colors of pixels of the color image Ic in terms of, for example, RGB values.

The white image data WIdata is data that specifies the white image Iw in the print image PI. Specifically, the white image data WIdata is data which specifies colors of pixels of the white image Iw in terms of, for example, Lab values. In most cases, generally, the white image Iw is an image with a white color (which includes a toned white color). In such cases, the pixel values of the respective pixels are the same. Hence, the white image data WIdata may be a combination between 2-bit data of each pixel for specifying an area, in which the white image Iw is formed, in the print image PI and data (the Lab values) for specifying the color of the white image Iw. Further, the color of the white image Iw is specified, for example, by a user with the aid of a keyboard KB or a mouse MOU. Alternatively, the color of the white image Iw is specified by color measurement for an object (for example, actually printed matter).

Figure 8A:
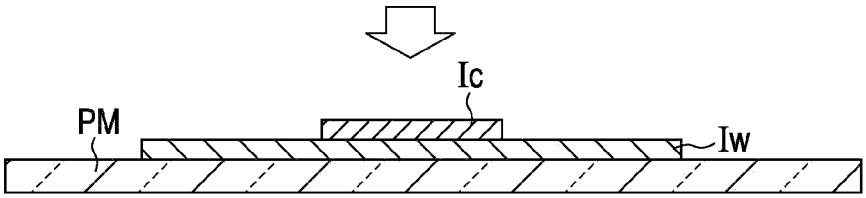
FIGS. 8A and 8B are explanatory diagrams illustrating printing orders of a color image and a white image.
Figure 8B:
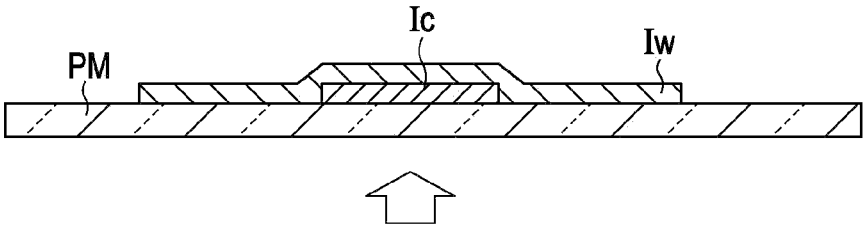

The printing-order specification information SS is information that specifies the printing order of the color image Ic and the white image Iw. FIGS. 8A and 8B are explanatory diagrams illustrating the printing orders of the color image Ic and the white image Iw. FIG. 8A shows a printing order in which the white image Iw is formed on a transparent film as a print medium PM and the color image Ic is formed on the white image Iw. In the specification, this printing order is referred to as "white-color printing" or "W-C printing". In the W-C printing shown in FIG. 8A, an observer observes a piece of printed matter from the upper side of FIG. 8A (refer to the arrow of FIG. 8A).

FIG. 8B shows a printing order in which the color image Ic is formed on the transparent film as the print medium PM and the white image Iw is formed on the color image Ic. In the specification, this printing order is referred to as "color-white printing" or "C-W printing". In the C-W printing shown in FIG. 8B, an observer observes a piece of printed matter from the lower side of FIG. 8B (refer to the arrow of FIG. 8B).

A user selects the W-C printing or the C-W printing in accordance with the intended use of the printed matter. The CPU 210, which executes the application program AP, outputs the printing-order specification information SS, which specifies the printing order selected by the user, to the printer driver 300 (FIG. 5).

The printing-mode specification information MS is information that specifies printing modes such as an image quality priority mode and speed priority mode. A user selects a printing mode in accordance with time allowed for printing and respective necessary image qualities of the color image Ic and the white image Iw. The CPU 210, which executes the application program AP, outputs the printing-mode specification information MS, which specifies the printing mode selected by the user, to the nozzle number setting module 380 of the printer driver 300 (FIG. 5). The nozzle number setting module 380 sets, on the basis of the printing-mode specification information MS, the number of nozzles used to form the color image Ic and the white image Iw, and outputs information, which specifies the number of nozzles, to the command creation module 370. In addition, the printing modes will be described in detail later.

When the data/information which is output from the application program AP is received in the printer driver 300 (FIG. 5), the CPU 210 starts a process of executing the printer driver 300. The printer driver 300 performs a color conversion process, an ink color separation process and a halftone process on the respective color image Ic and white image Iw. Specifically, the color conversion module 302 for color image converts color from RGB values of the color image data Cdata to CMYK values, and the ink-color-separation processing module 310 for color image converts the CMYK values into grayscale values for the respective ink colors. Then, the halftone processing module 320 for color image converts the grayscale values for the respective ink colors into color-image dot data which defines ON/OFF states of dots of the respective ink colors of the respective pixels. Further, the color conversion module 340 for white image converts color from Lab values of the white image data WIdata to CMYK values, and the ink-color-separation processing module 350 for white image converts the CMYK values into grayscale values for the respective ink colors. Then, the halftone processing module 360 for white image converts the grayscale values for the respective ink colors into white-image dot data which defines ON/OFF states of dots of the respective ink colors of the respective pixels.

The generated color-image dot data and white-image dot data is received, together with the printing-order specification information SS and the printing-mode specification information MS, by the command creation module 370 (FIG. 5). On the basis of the color-image dot data, the white-image dot data, and the information which is received from the nozzle number setting module 380 and specifies the number of nozzles used to form the color image Ic and the white image Iw, the command creation module 370 creates a print command for performing printing of the print image PI on the printer 100 in the printing order designated by the printing-order specification information SS by using the printing mode designated by the printing-mode specification information MS. Then, the command creation module 370 outputs the print command to the printer 100.

The CPU 110, which executes the command processing module 112 (FIG. 6) of the printer 100, receives and processes the print command transmitted from the printer driver 300 of the PC 200. Specifically, the command processing module 112 stores the raster data (the dot data), which is included in the print command, in the raster buffer 132. At this time, the raster data for the color image Ic is stored in the raster buffer 132*c* for color image, and the raster data for the white image Iw is stored in the raster buffer 132*w* for white image. Further, when a predetermined number of pieces of raster data is stored in the raster buffer 132, the command processing module 112 transmits the raster data from the raster buffer 132 to the head buffer 142. On the basis of the raster data stored in the head buffer 142, the CPU 110 controls the print medium feeding controller 160 and the print medium feeding motor 162 such that they perform the sub-scanning, and simultaneously controls the CR controller 150 and the CR motor 152 such that they perform the main scanning, thereby printing the print image PI.

A-3. Printing Mode

Figure 9:
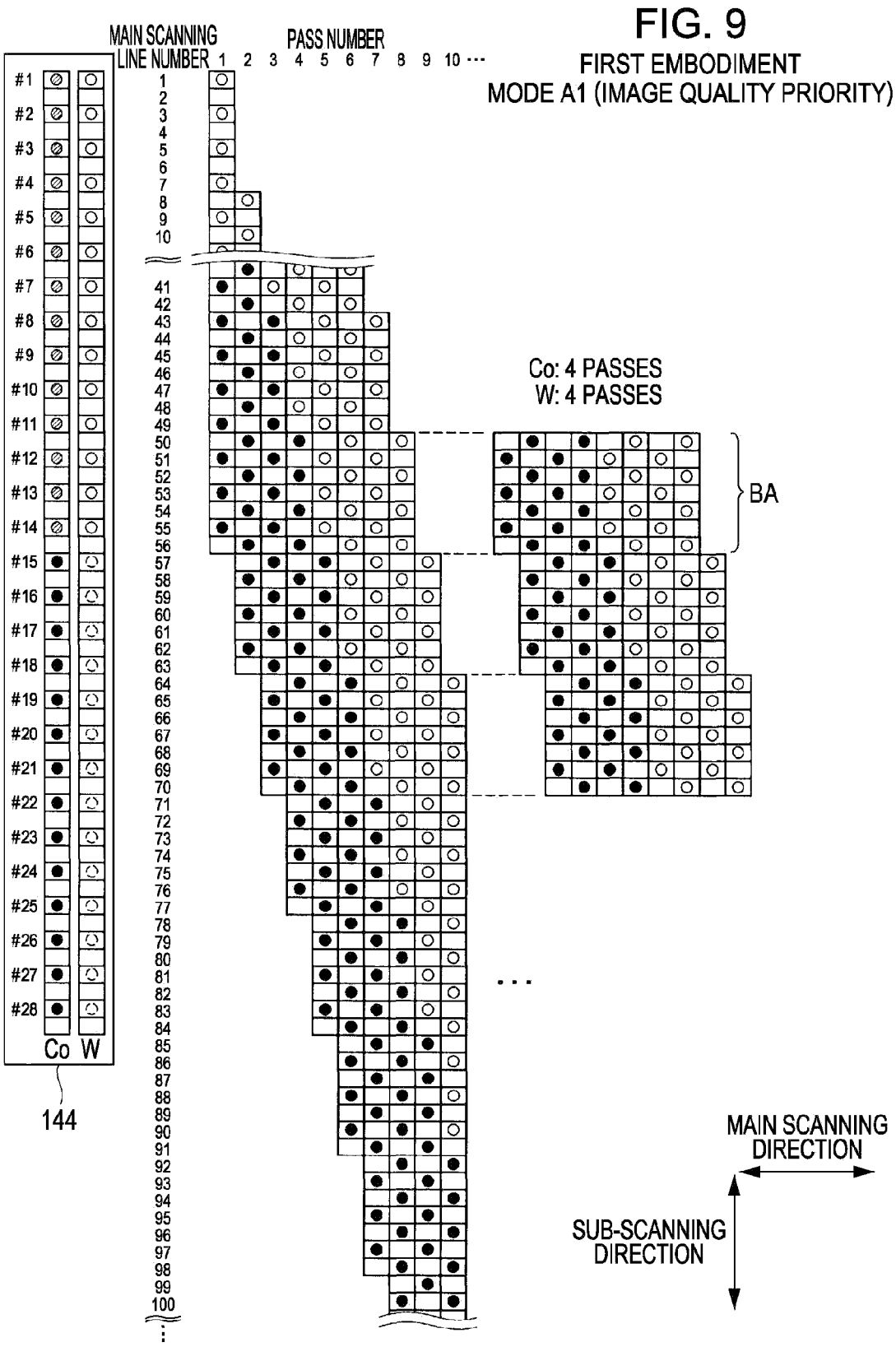
FIG. 9 is an explanatory diagram illustrating a printing method of a printing mode according to the first embodiment.
Figure 10:
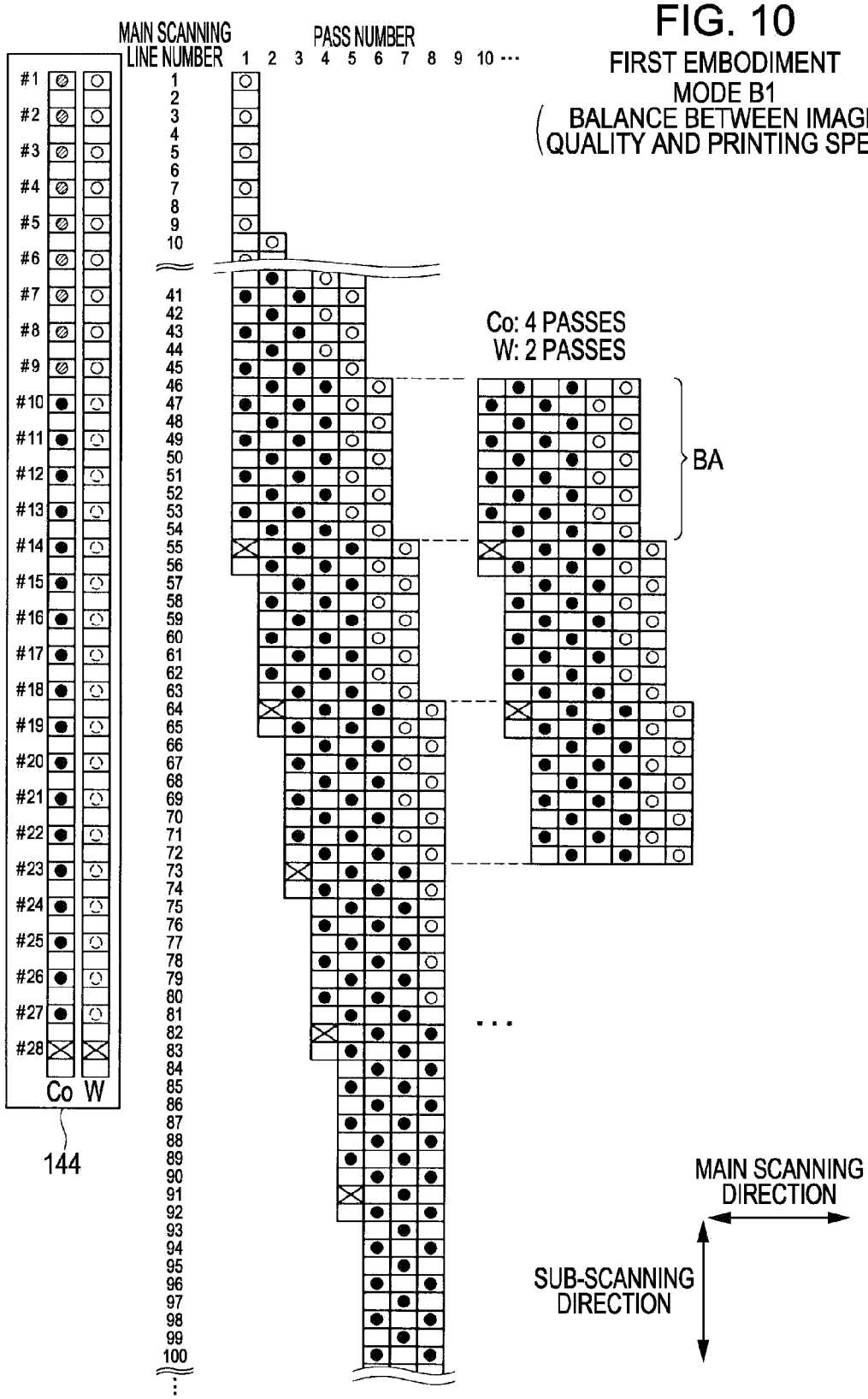
FIG. 10 is an explanatory diagram illustrating a printing method of a printing mode according to the first embodiment.
Figure 11:
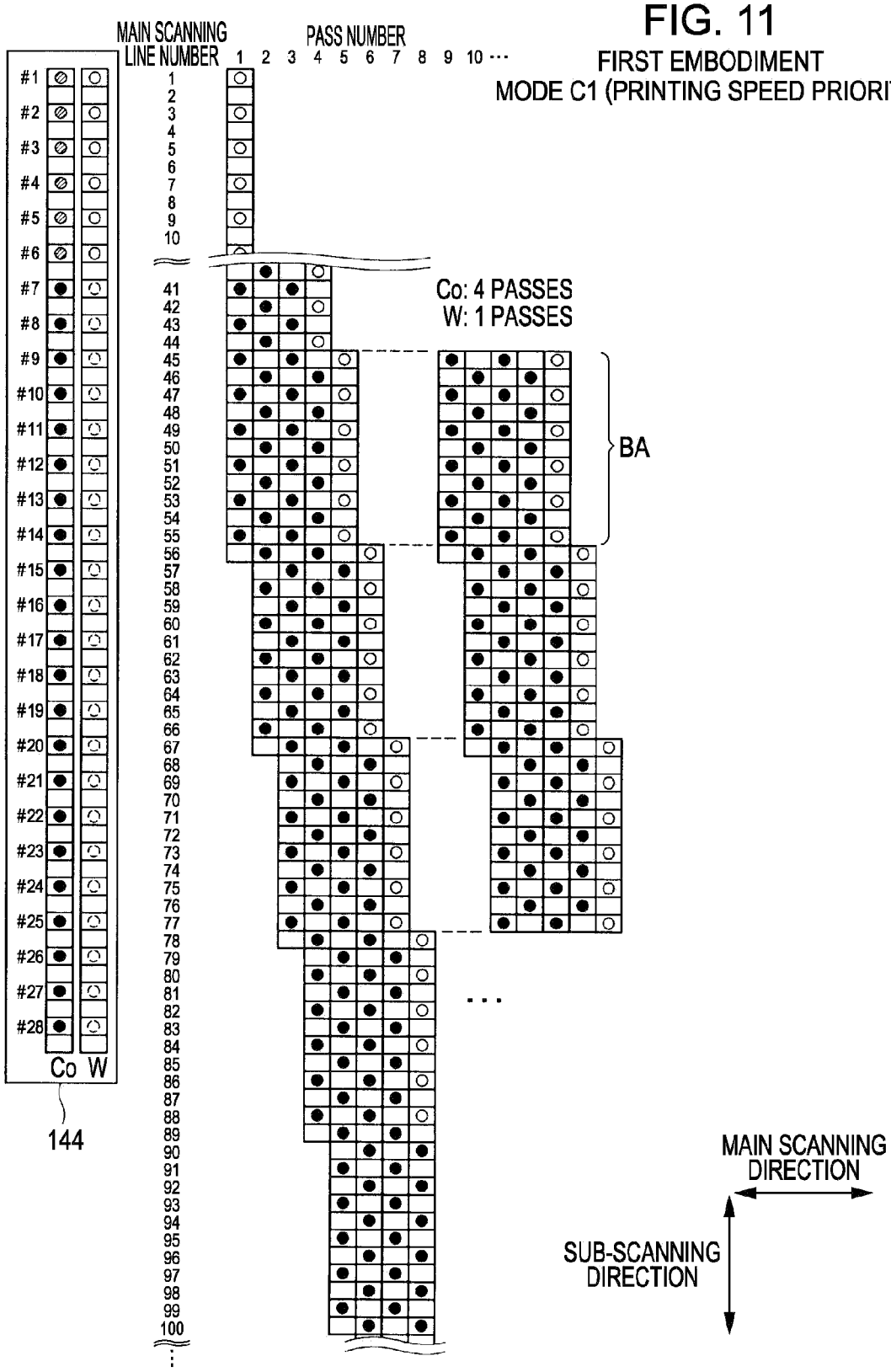
FIG. 11 is an explanatory diagram illustrating a printing method of a printing mode according to the first embodiment.

The printing system 10 of the first embodiment is able to perform the printing process of forming the color image Ic and the white image Iw on a print medium in an overlapping manner, by using three printing modes including a printing mode A1 in which the print image quality has priority, a printing mode B1 in which the print image quality and the printing speed are balanced, and a printing mode C1 in which the printing speed has priority. FIGS. 9 to 11 are explanatory diagrams illustrating printing methods in the respective printing modes of the first embodiment. In the left side of each drawing, arrangement is shown of the nozzle groups used to form the color image Ic and the white image Iw in the nozzle arrays of the print head 144 (FIG. 4). In the right side thereof, positions are shown of the nozzle arrays in the sub-scanning direction for each printing pass (each image formation operation).

In each drawing, the nozzle array, which is indicated by "W", represents the nozzle array (hereinafter referred to as "white nozzle array W") corresponding to the white color. In addition, the nozzle array, which is indicated by "Co", represents one representative of the nozzle arrays (hereinafter referred to as "color nozzle arrays Co") corresponding to the respective colors (cyan (C), magenta (M), yellow (Y), and black (K)) other than the white color. The arrangement of the nozzle groups, which is used to form the color image Ic and white image Iw, is common to the respective color nozzle arrays Co of C, M, Y, and K. The white nozzle array W corresponds to the second nozzle array in the embodiment of the invention. In addition, at least one of the color nozzle arrays Co corresponds to the first nozzle array in the embodiment of the invention. In each drawing, among the nozzles constituting the color nozzle array Co, the nozzles indicated by the black circles are nozzles which are used to form the color image Ic, and the nozzles indicated by the hatched circles are nozzles which are not used to form the color image Ic. Further, in each drawing, among the nozzles constituting the white nozzle array W, the nozzles indicated by the solid white circles are nozzles which are used to form the white image Iw, and the nozzles indicated by the dashed white circles are nozzles which are not used to form the white image Iw. As described above, since the white image Iw includes the toned white image, among the respective nozzles constituting the color nozzle array Co, the nozzles indicated by the hatched circles are not used to form the color image Ic, but may be used to form the white image Iw (the toned white image). Further, in the drawing showing the positions of the nozzle arrays in the sub-scanning direction for each printing pass in the right side of each drawing, the black circles represent the positions of the nozzles, which are used to form the color image Ic, in the sub-scanning direction, and the white circles represent the positions of the nozzles, which are used to form the white image Iw, in the sub-scanning direction. The signs in the drawing have the same meaning as the signs in the drawings corresponding to the following embodiments.

FIG. 9 shows a printing method in the printing mode A1 in which the print image quality has priority. In the first embodiment, each nozzle array includes 28 nozzles, and the nozzle pitch d corresponds to two rasters. As shown in FIG. 9, in the printing mode A1, among the nozzles constituting the color nozzle array Co, 15th to 28th 14 nozzles (hereinafter referred to as "the nozzle group for the first image in the printing mode A1") are used to form the color image Ic, and the other nozzles are not used to form the color image Ic. Further, among the nozzles constituting the white nozzle array W, 1st to 14th 14 nozzles (hereinafter referred to as "the nozzle group for the second image in the printing mode A1") are used to form the white image Iw, and the other nozzles are not used to form the white image Iw. That is, in the printing mode A1, the number of nozzles, which are used to form the color image Ic, in the color nozzle array Co is equal to the number of nozzles, which are used to form the white image Iw, in the white nozzle array W.

As shown in FIG. 9, in the printing mode A1, the area (hereinafter referred to as a "unit band BA"), which has a predetermined width in the sub-scanning direction, in the color image Ic is formed by four printing passes. More specifically, in the main scanning direction, each raster is formed by two printing passes (that is, each raster is formed by using two different nozzles). In addition, as the number of nozzles used to form one raster is larger, it is difficult to notice the variation of the ink dot positions caused by mechanical variation in nozzle position, and thus image quality is improved. The main scanning direction resolution in each printing pass is the same as the highest resolution of the printer 100. Further, in the sub-scanning direction, between plural dots formed in each printing pass, dots formed by another single printing pass are disposed. Hence, the sub-scanning direction resolution of the color image Ic is twice as fine (minute) as the nozzle pitch, and the main scanning direction resolution thereof is twice as fine as the highest resolution of the printer 100. In addition, generally, image quality thereof is improved to a degree as fine as the print resolution.

Further, as shown in FIG. 9, in the printing mode A1, similarly to the unit band BA of the color image Ic, the unit band BA of the white image Iw is formed by four printing passes. Hence, the sub-scanning direction resolution of the white image Iw is twice as fine as the nozzle pitch, and the main scanning direction resolution thereof is twice as fine as the highest resolution of the printer 100.

As described above, in the printing mode A1, four printing passes are necessary for printing the unit band BA of the color image Ic, and four printing passes are necessary for printing the unit band BA of the white image Iw. Hence, a total of eight printing passes are necessary for printing the unit band BA of the print image PI. Further, the sub-scanning direction resolution of the print image PI in both cases of the color image Ic and the white image Iw is twice as fine as the nozzle pitch, and the main scanning direction resolution thereof in both cases of the color image Ic and the white image Iw is twice as fine as the highest resolution of the printer 100. In addition, the printing process shown in FIG. 9 is the color-white printing (the C-W printing) in which the color image Ic is formed on the print medium and the white image Iw is formed on the color image Ic. Likewise, the printing processes shown in the drawings corresponding to other printing modes of the embodiment and other embodiments are also the color-white printing.

FIG. 10 shows a printing method in the printing mode B1 in which the print image quality and the printing speed are balanced. As shown in FIG. 10, in the printing mode B1, among the nozzles constituting the color nozzle array Co, 10th to 27th 18 nozzles (hereinafter referred to as "the nozzle group for the first image in the printing mode B1") are used to form the color image Ic, and the other nozzles are not used to form the color image Ic. Further, among the nozzles constituting the white nozzle array W, 1st to 9th 9 nozzles (hereinafter referred to as "the nozzle group for the second image in the printing mode B1") are used to form the white image Iw, and the other nozzles are not used to form the white image Iw. Further, among the nozzles constituting the color nozzle array Co and the white nozzle array W, the 28th nozzle indicated by X is not used to form any of the color image Ic and the white image Iw. That is, in the printing mode B1, the number of nozzles, which are used to form the color image Ic, in the color nozzle array Co is larger than the number of nozzles, which are used to form the white image Iw, in the white nozzle array W. Accordingly, in the printing mode B1, as compared with the above-mentioned printing mode A1, the number of nozzles, which are used to form the color image Ic, is large, whereas the number of nozzles, which are used to form the white image Iw, is small.

As shown in FIG. 10, in the printing mode B1, similarly to the printing mode A1 shown in FIG. 9, the unit band BA of the color image Ic is formed by four printing passes. Hence, the sub-scanning direction resolution of the color image Ic is twice as fine as the nozzle pitch, and the main scanning direction resolution thereof is twice as fine as the highest resolution of the printer 100.

Further, as shown in FIG. 10, in the printing mode B1, the unit band BA of the white image Iw is formed by two printing passes. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another single printing pass are disposed. Hence, the sub-scanning direction resolution of the white image Iw is twice as fine as the nozzle pitch, and the main scanning direction resolution thereof is the same as the highest resolution of the printer 100.

As described above, in the printing mode B1, four printing passes are necessary for printing the unit band BA of the color image Ic, and two printing passes are necessary for printing the unit band BA of the white image Iw. Hence, a total of six printing passes are necessary for printing the unit band BA of the print image PI. Further, the sub-scanning direction resolution of the print image PI in both cases of the color image Ic and the white image Iw is twice as fine as the nozzle pitch. In contrast, the main scanning direction resolution thereof in the case of the color image Ic is twice the highest resolution of the printer 100, but the main scanning direction resolution thereof in the case of the white image Iw is the same as the highest resolution of the printer 100. Hence, in the printing mode B1, the printing speed is higher than that in the printing mode A1, and the image quality of the white image Iw is lower than that in the printing mode A1.

FIG. 11 shows a printing method in the printing mode C1 in which the printing speed has priority. As shown in FIG. 11, in the printing mode C1, among the nozzles constituting the color nozzle array Co, 7th to 28th 22 nozzles (hereinafter referred to as "the nozzle group for the first image in the printing mode C1") are used to form the color image Ic, and the other nozzles are not used to form the color image Ic. Further, among the nozzles constituting the white nozzle array W, 1st to 6th 6 nozzles (hereinafter referred to as "the nozzle group for the second image in the printing mode C1") are used to form the white image Iw, and the other nozzles are not used to form the white image Iw. That is, in the printing mode C1, the number of nozzles, which are used to form the color image Ic, in the color nozzle array Co is larger than the number of nozzles, which are used to form the white image Iw, in the white nozzle array W. In the printing mode C1, the ratio of the number of nozzles (the number of nozzles used to form the color image Ic), which constitute the nozzle group for the first image, to the number of nozzles (the number of nozzles used to form the white image Iw), which constitute the nozzle group for the second image, is larger than the ratio in the above-mentioned printing mode B1. Accordingly, in the printing mode C1, as compared with the above-mentioned printing modes A1 and B1, the number of nozzles, which are used to form the color image Ic, is large, whereas the number of nozzles, which are used to form the white image Iw, is small.

As shown in FIG. 11, in the printing mode C1, similarly to the printing mode A1 shown in FIG. 9, the unit band BA of the color image Ic is formed by four printing passes. Hence, the sub-scanning direction resolution of the color image Ic is twice as fine as the nozzle pitch, and the main scanning direction resolution thereof is twice as fine as the highest resolution of the printer 100.

Further, as shown in FIG. 11, in the printing mode C1, the unit band BA of the white image Iw is formed by a single printing pass. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is the same as the highest resolution of the printer 100.

As described above, in the printing mode C1, four printing passes are necessary for printing the unit band BA of the color image Ic, and a single printing pass is necessary for printing the unit band BA of the white image Iw. Hence, a total of five printing passes are necessary for printing the unit band BA of the print image PI. Further, the sub-scanning direction resolution of the print image PI in the case of the color image Ic is twice as fine as the nozzle pitch, but the sub-scanning direction resolution thereof in the case of the white image Iw is the same as the nozzle pitch. In addition, the main scanning direction resolution thereof in the case of the color image Ic is twice as fine as the highest resolution of the printer 100, but the main scanning direction resolution thereof in the case of the white image Iw is the same as the highest resolution of the printer 100. Hence, in the printing mode C1, the printing speed is higher than those in the printing modes A1 and B1, and the image quality of the white image Iw is lower than those in the printing modes A1 and B1.

As described above, in the printing system 10 of the embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw. Further, in the printing mode A1 in which the print image quality has priority, the number of nozzles, which constitute the nozzle group for the first image used to form the color image Ic, is equal to the number of nozzles which constitute the nozzle group for the second image used to form the white image Iw. In printing mode B1 in which the print image quality and the printing speed are balanced and the printing mode C1 in which the printing speed has priority, the number of nozzles, which constitute the nozzle group for the first image used to form the color image Ic, is larger than the number of nozzles which constitute the nozzle group for the second image used to form the white image Iw. In the printing mode C1, the ratio of the number of nozzles (the number of nozzles used to form the color image Ic), which constitute the nozzle group for the first image, to the number of nozzles (the number of nozzles used to form the white image Iw), which constitute the nozzle group for the second image, is larger than the ratio in the above-mentioned printing mode B1. Hence, the printing speed is higher in order of the printing modes C1, B1, and A1, and the image quality of the white image Iw is better in order of the printing modes A1, B1, and C1. Accordingly, in the printing system 10 of the embodiment, for example, in a case where a decrease in printing time is more important than suppressing deterioration in the image quality of the white image Iw, the printing mode C1 is selected. In contrast, in a case where suppressing deterioration in the image quality of the white image Iw is more important than the decrease in printing time, the printing mode A1 or B1 is selected. In such a manner, it is possible to achieve a printing process appropriate for the use and purpose thereof. Further, in the printing system 10 of the embodiment, it is possible to achieve a printing process of concurrently forming the color image Ic and the white image Iw without providing the head or the nozzle array for forming the white image Iw on the upstream side and/or the downstream side of the sub-scanning direction of the head or the nozzle array for forming the color image Ic. Accordingly, in the printing system 10 of the embodiment, when performing the printing process of forming two images on a print medium in an overlapping manner, it is possible to achieve a printing process appropriate for the use and purpose thereof while suppressing an increase in the size of the apparatus.

B. Second Embodiment

Figure 12:
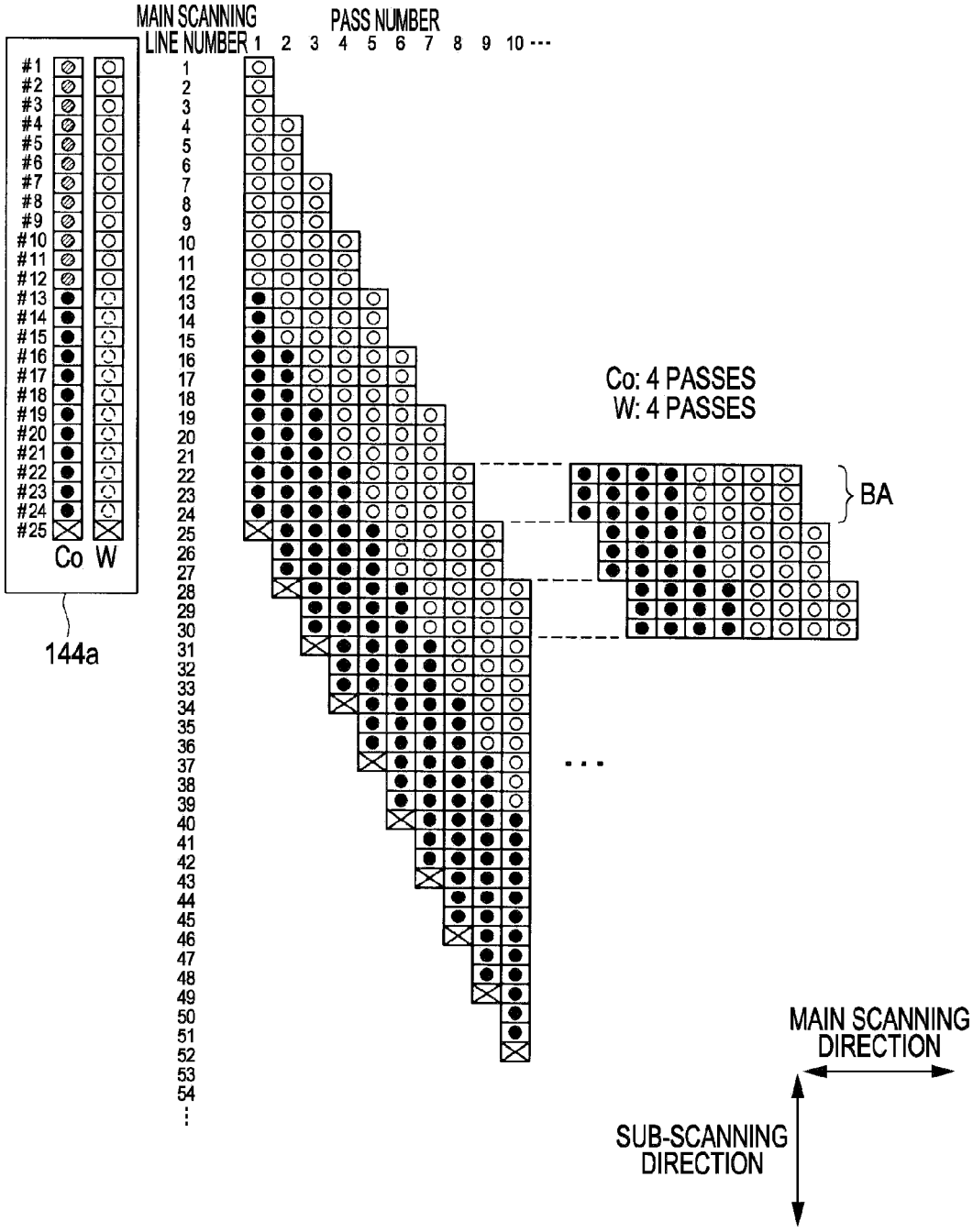
FIG. 12 is an explanatory diagram illustrating a printing method of a printing mode according to a second embodiment.
Figure 13:
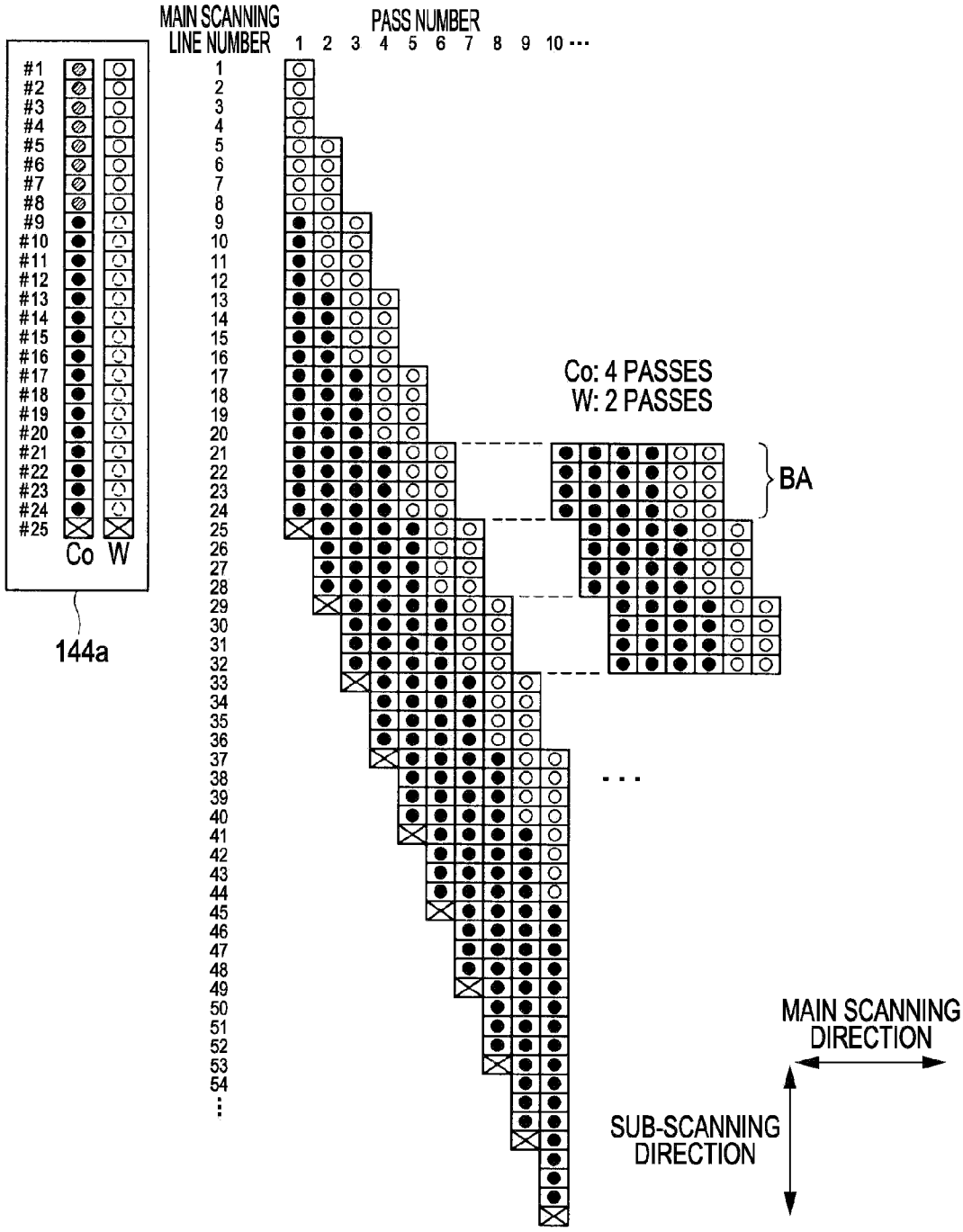
FIG. 13 is an explanatory diagram illustrating a printing method of a printing mode according to the second embodiment.
Figure 14:
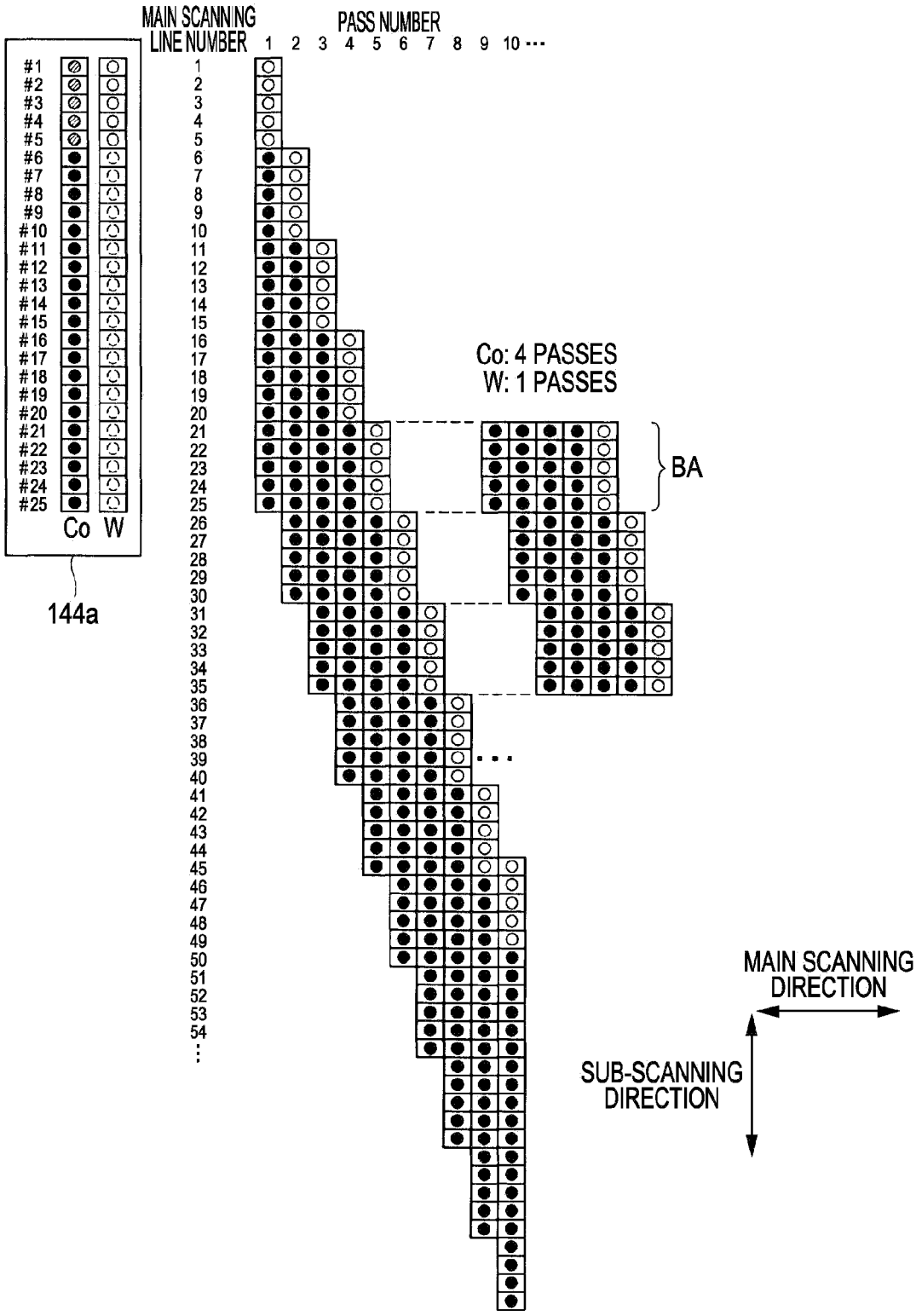
FIG. 14 is an explanatory diagram illustrating a printing method of a printing mode according to the second embodiment.

The printing system 10 of the second embodiment is able to perform the printing process of forming the color image Ic and the white image Iw on a print medium in an overlapping manner, by using three printing modes including a printing mode A2 in which the print image quality has priority, a printing mode B2 in which the print image quality and the printing speed are balanced, and a printing mode C2 in which the printing speed has priority. In addition, the printing system 10 has the same configuration as that of the first embodiment. FIGS. 12 to 14 are explanatory diagrams illustrating printing methods in the respective printing modes of the second embodiment. In the second embodiment, each nozzle array of the print head 144*a* includes 25 nozzles, and the nozzle pitch d corresponds to a single raster.

FIG. 12 shows a printing method in the printing mode A2 in which the print image quality has priority. As shown in FIG. 12, in the printing mode A2, among the nozzles constituting the color nozzle array Co, 13th to 24th 12 nozzles (hereinafter referred to as "the nozzle group for the first image in the printing mode A2") are used to form the color image Ic, and the other nozzles are not used to form the color image Ic. Further, among the nozzles constituting the white nozzle array W, 1st to 12th 12 nozzles (hereinafter referred to as "the nozzle group for the second image in the printing mode A2") are used to form the white image Iw, and the other nozzles are not used to form the white image Iw. Further, among the nozzles constituting the color nozzle array Co and the white nozzle array W, the 25th nozzle indicated by X is not used to form any of the color image Ic and the white image Iw. That is, in the printing mode A2, the number of nozzles, which are used to form the color image Ic, in the color nozzle array Co is equal to the number of nozzles, which are used to form the white image Iw, in the white nozzle array W.

As shown in FIG. 12, in the printing mode A2, the unit band BA of the color image Ic is formed by four printing passes. More specifically, in the main scanning direction, each raster is formed by four printing passes (that is, each raster is formed by using four different nozzles). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the color image Ic is the same as the nozzle pitch, and the main scanning direction resolution thereof is four times as fine as the highest resolution of the printer 100.

Further, as shown in FIG. 12, in the printing mode A2, similarly to the unit band BA of the color image Ic, the unit band BA of the white image Iw is also formed by four printing passes. Hence, the sub-scanning direction resolution of the white image Iw is the same as the nozzle pitch, and the main scanning direction resolution thereof is four times as fine as the highest resolution of the printer 100.

As described above, in the printing mode A2, four printing passes are necessary for printing the unit band BA of the color image Ic, and four printing passes are necessary for printing the unit band BA of the white image Iw. Hence, a total of eight printing passes are necessary for printing the unit band BA of the print image PI. Further, the sub-scanning direction resolution of the print image PI in both cases of the color image Ic and the white image Iw is the same as the nozzle pitch, and the main scanning direction resolution thereof in both cases of the color image Ic and the white image Iw is four times as fine as the highest resolution of the printer 100.

FIG. 13 shows a printing method in the printing mode B2 in which the print image quality and the printing speed are balanced. As shown in FIG. 13, in the printing mode B2, among the nozzles constituting the color nozzle array Co, 9th to 24th 16 nozzles (hereinafter referred to as "the nozzle group for the first image in the printing mode B2") are used to form the color image Ic, and the other nozzles are not used to form the color image Ic. Further, among the nozzles constituting the white nozzle array W, 1st to 8th 8 nozzles (hereinafter referred to as "the nozzle group for the second image in the printing mode B2") are used to form the white image Iw, and the other nozzles are not used to form the white image Iw. Further, among the nozzles constituting the color nozzle array Co and the white nozzle array W, the 25th nozzle indicated by X is not used to form any of the color image Ic and the white image Iw. That is, in the printing mode B2, the number of nozzles, which are used to form the color image Ic, in the color nozzle array Co is larger than the number of nozzles, which are used to form the white image Iw, in the white nozzle array W. Accordingly, in the printing mode B2, as compared with the above-mentioned printing mode A2, the number of nozzles, which are used to form the color image Ic, is large, whereas the number of nozzles, which are used to form the white image Iw, is small.

As shown in FIG. 13, in the printing mode B2, similarly to the printing mode A2 shown in FIG. 12, the unit band BA of the color image Ic is formed by four printing passes. Hence, the sub-scanning direction resolution of the color image Ic is the same as the nozzle pitch, and the main scanning direction resolution thereof is four times as fine as the highest resolution of the printer 100.

Further, as shown in FIG. 13, in the printing mode B2, the unit band BA of the white image Iw is formed by two printing passes. More specifically, in the main scanning direction, each raster is formed by two printing passes (that is, each raster is formed by using two different nozzles). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is twice as fine as the highest resolution of the printer 100.

As described above, in the printing mode B2, four printing passes are necessary for printing the unit band BA of the color image Ic, and two printing passes are necessary for printing the unit band BA of the white image Iw. Hence, a total of six printing passes are necessary for printing the unit band BA of the print image PI. Further, the sub-scanning direction resolution of the print image PI in both cases of the color image Ic and the white image Iw is the same as the nozzle pitch. In contrast, the main scanning direction resolution thereof in the case of the color image Ic is four times as fine as the highest resolution of the printer 100, but the main scanning direction resolution thereof in the case of the white image Iw is twice as fine as the highest resolution of the printer 100. Hence, in the printing mode B2, the printing speed is higher than that in the printing mode A2, and the image quality of the white image Iw is lower than that in the printing mode A2.

FIG. 14 shows a printing method in the printing mode C2 in which the printing speed has priority. As shown in FIG. 14, in the printing mode C2, among the nozzles constituting the color nozzle array Co, 6th to 25th 20 nozzles (hereinafter referred to as "the nozzle group for the first image in the printing mode C2") are used to form the color image Ic, and the other nozzles are not used to form the color image Ic. Further, among the nozzles constituting the white nozzle array W, 1st to 5th 5 nozzles (hereinafter referred to as "the nozzle group for the second image in the printing mode C2") are used to form the white image Iw, and the other nozzles are not used to form the white image Iw. That is, in the printing mode C2, the number of nozzles, which are used to form the color image Ic, in the color nozzle array Co is larger than the number of nozzles, which are used to form the white image Iw, in the white nozzle array W. In the printing mode C2, the ratio of the number of nozzles (the number of nozzles used to form the color image Ic), which constitute the nozzle group for the first image, to the number of nozzles (the number of nozzles used to form the white image Iw), which constitute the nozzle group for the second image, is larger than the ratio in the above-mentioned printing mode B2. Accordingly, in the printing mode C2, as compared with the above-mentioned printing modes A2 and B2, the number of nozzles, which are used to form the color image Ic, is large, whereas the number of nozzles, which are used to form the white image Iw, is small.

As shown in FIG. 14, in the printing mode C2, similarly to the printing mode A2 shown in FIG. 12, the unit band BA of the color image Ic is formed by four printing passes. Hence, the sub-scanning direction resolution of the color image Ic is the same as the nozzle pitch, and the main scanning direction resolution thereof is four times as fine as the highest resolution of the printer 100.

Further, as shown in FIG. 14, in the printing mode C2, the unit band BA of the white image Iw is formed by a single printing pass. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is the same as the highest resolution of the printer 100.

As described above, in the printing mode C2, four printing passes are necessary for printing the unit band BA of the color image Ic, and a single printing pass is necessary for printing the unit band BA of the white image Iw. Hence, a total of five printing passes are necessary for printing the unit band BA of the print image PI. Further, the sub-scanning direction resolution of the print image PI in both cases of the color image Ic and the white image Iw is the same as the nozzle pitch. In contrast, the main scanning direction resolution thereof in the case of the color image Ic is four times as fine as the highest resolution of the printer 100, but the main scanning direction resolution thereof in the case of the white image Iw is the same as the highest resolution of the printer 100. Hence, in the printing mode C2, the printing speed is higher than those in the printing modes A2 and B2, and the image quality of the white image Iw is lower than those in the printing modes A2 and B2.

As described above, also in the printing system 10 of the second embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A2 in which the print image quality has priority, the number of nozzles, which constitute the nozzle group for the first image used to form the color image Ic, is equal to the number of nozzles which constitute the nozzle group for the second image used to form the white image Iw. In printing mode B2 in which the print image quality and the printing speed are balanced and the printing mode C2 in which the printing speed has priority, the number of nozzles, which constitute the nozzle group for the first image used to form the color image Ic, is larger than the number of nozzles which constitute the nozzle group for the second image used to form the white image Iw. In the printing mode C2, the ratio of the number of nozzles (the number of nozzles used to form the color image Ic), which constitute the nozzle group for the first image, to the number of nozzles (the number of nozzles used to form the white image Iw), which constitute the nozzle group for the second image, is larger than the ratio in the above-mentioned printing mode B2. Hence, the printing speed is higher in order of the printing modes C2, B2, and A2, and the image quality of the white image Iw is better in order of the printing modes A2, B2, and C2. Accordingly, in the printing system 10 of the embodiment, for example, in the case where a decrease in printing time is more important than suppressing deterioration in the image quality of the white image Iw, the printing mode C2 is selected. In contrast, in the case where suppressing deterioration in the image quality of the white image Iw is more important than the decrease in printing time, the printing mode A2 or B2 is selected. In such a manner, it is possible to achieve a printing process appropriate for the use and purpose thereof. As a result, in the printing system 10 of the second embodiment, when performing the printing process of forming two images on a print medium in an overlapping manner, it is possible to achieve a printing process appropriate for the use and purpose thereof while suppressing an increase in the size of the apparatus.

C. Third Embodiment

Figure 15:
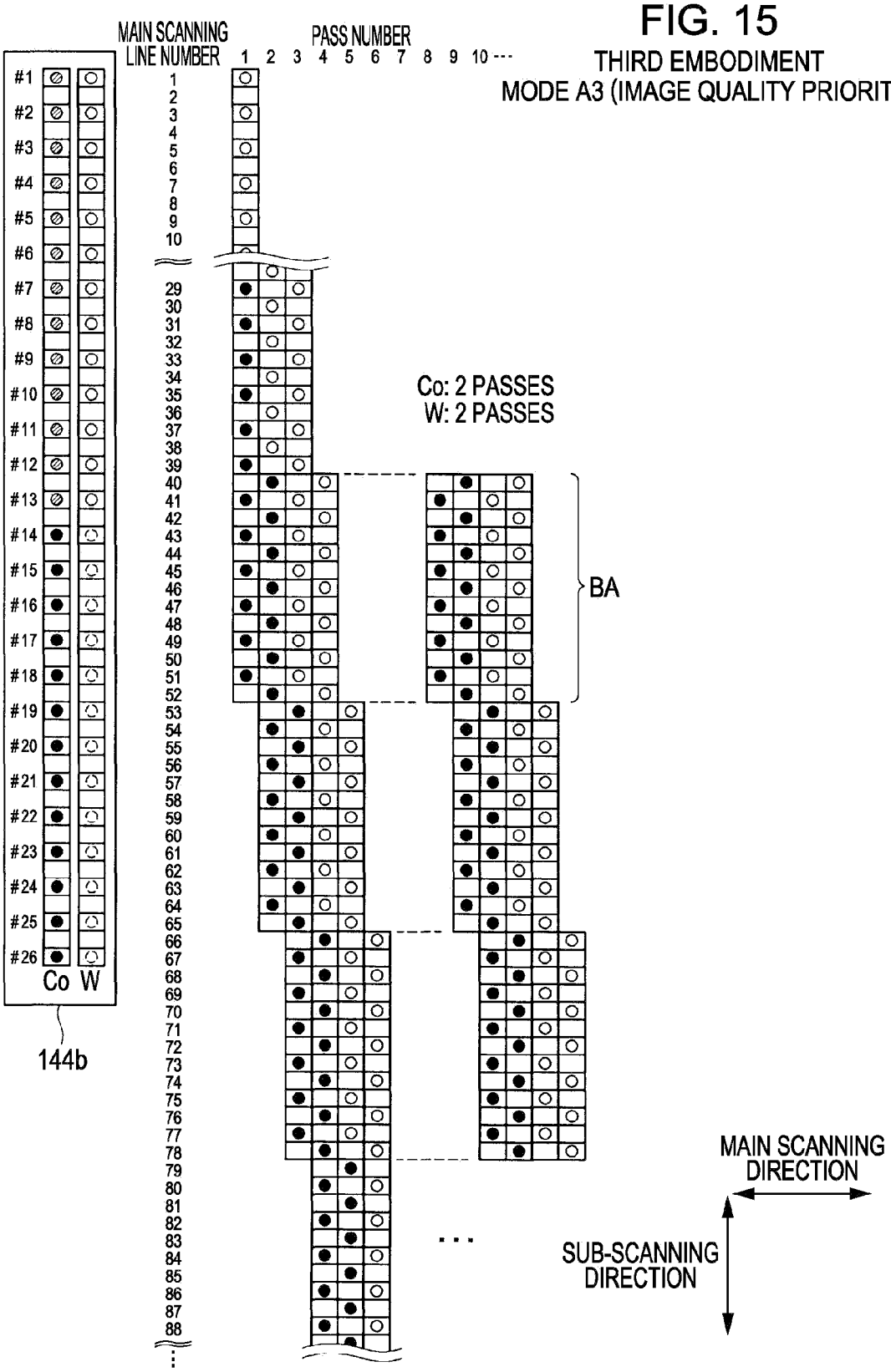
FIG. 15 is an explanatory diagram illustrating a printing method of a printing mode according to a third embodiment.
Figure 16:
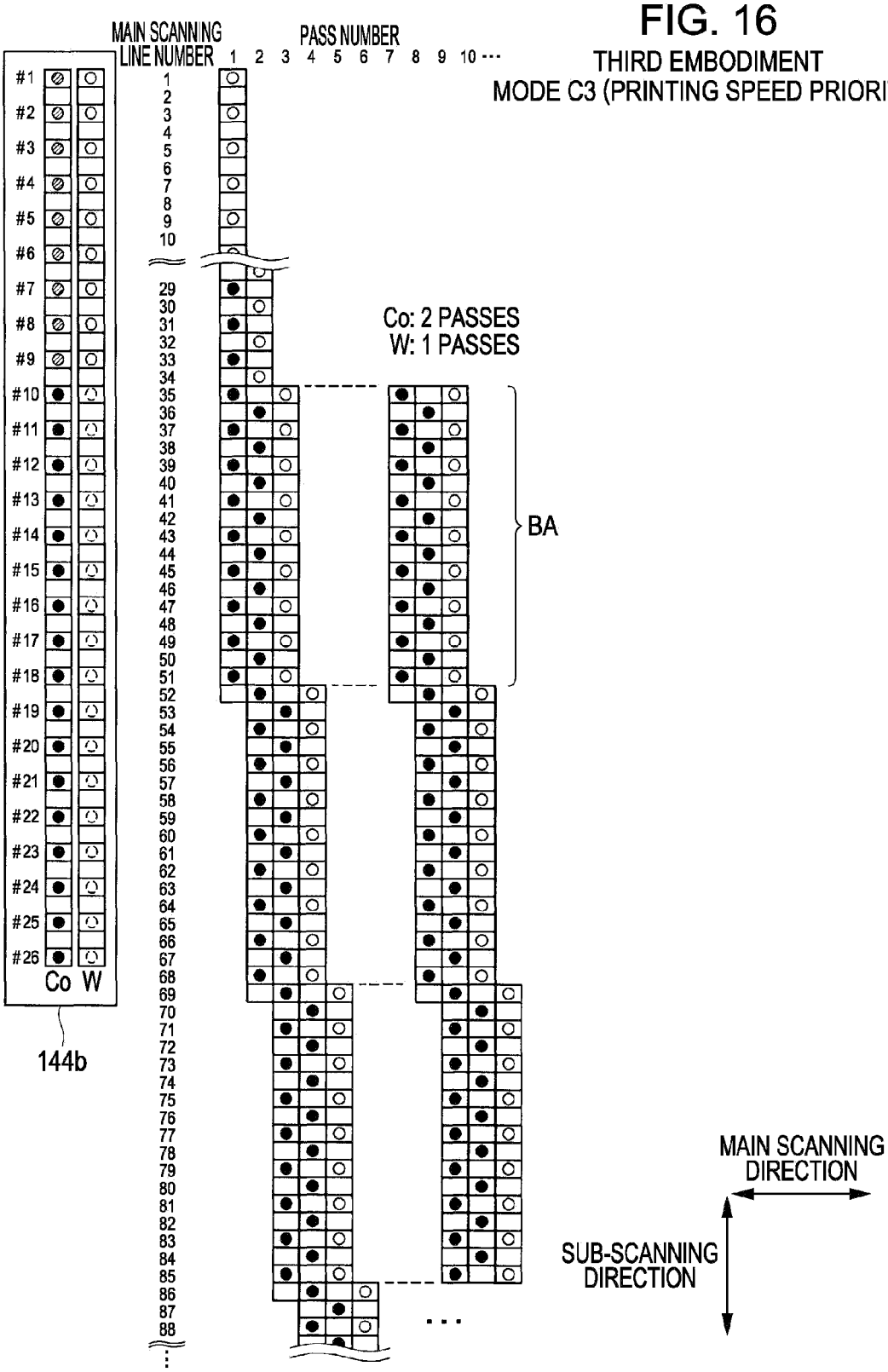
FIG. 16 is an explanatory diagram illustrating a printing method of a printing mode according to the third embodiment.

The printing system 10 of the third embodiment is able to perform the printing process of forming the color image Ic and the white image Iw on a print medium in an overlapping manner, by using two printing modes including a printing mode A3 in which the print image quality has priority and a printing mode C3 in which the printing speed has priority. In addition, the printing system 10 has the same configuration as that of the first embodiment. FIGS. 15 and 16 are explanatory diagrams illustrating printing methods in the respective printing modes of the third embodiment. In the third embodiment, each nozzle array of the print head 144*b* includes 26 nozzles, and the nozzle pitch d corresponds to two rasters.

FIG. 15 shows a printing method in the printing mode A3 in which the print image quality has priority. As shown in FIG. 15, in the printing mode A3, among the nozzles constituting the color nozzle array Co, 14th to 26th 13 nozzles (hereinafter referred to as "the nozzle group for the first image in the printing mode A3") are used to form the color image Ic, and the other nozzles are not used to form the color image Ic. Further, among the nozzles constituting the white nozzle array W, 1st to 13th 13 nozzles (hereinafter referred to as "the nozzle group for the second image in the printing mode A3") are used to form the white image Iw, and the other nozzles are not used to form the white image Iw. That is, in the printing mode A3, the number of nozzles, which are used to form the color image Ic, in the color nozzle array Co is equal to the number of nozzles, which are used to form the white image Iw, in the white nozzle array W.

As shown in FIG. 15, in the printing mode A3, the unit band BA of the color image Ic is formed by two printing passes. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another single printing pass are disposed. Hence, the sub-scanning direction resolution of the color image Ic is twice as fine as the nozzle pitch, and the main scanning direction resolution thereof is the same as the highest resolution of the printer 100.

Further, as shown in FIG. 15, in the printing mode A3, similarly to the unit band BA of the color image Ic, the unit band BA of the white image Iw is also formed by two printing passes. Hence, the sub-scanning direction resolution of the white image Iw is twice as fine as the nozzle pitch, and the main scanning direction resolution thereof is the same as the highest resolution of the printer 100.

As described above, in the printing mode A3, two printing passes are necessary for printing the unit band BA of the color image Ic, and two printing passes are necessary for printing the unit band BA of the white image Iw. Hence, a total of four printing passes are necessary for printing the unit band BA of the print image PI. Further, the sub-scanning direction resolution of the print image PI in both cases of the color image Ic and the white image Iw is twice as fine as the nozzle pitch, and the main scanning direction resolution thereof in both cases of the color image Ic and the white image Iw is the same as the highest resolution of the printer 100.

FIG. 16 shows a printing method in the printing mode C3 in which the printing speed has priority. As shown in FIG. 16, in the printing mode C3, among the nozzles constituting the color nozzle array Co, 10th to 26th 17 nozzles (hereinafter referred to as "the nozzle group for the first image in the printing mode C3") are used to form the color image Ic, and the other nozzles are not used to form the color image Ic. Further, among the nozzles constituting the white nozzle array W, 1st to 9th 9 nozzles (hereinafter referred to as "the nozzle group for the second image in the printing mode C3") are used to form the white image Iw, and the other nozzles are not used to form the white image Iw. That is, in the printing mode C3, the number of nozzles, which are used to form the color image Ic, in the color nozzle array Co is larger than the number of nozzles, which are used to form the white image Iw, in the white nozzle array W. Accordingly, in the printing mode C3, as compared with the above-mentioned printing mode A3, the number of nozzles, which are used to form the color image Ic, is large, whereas the number of nozzles, which are used to form the white image Iw, is small.

As shown in FIG. 16, in the printing mode C3, similarly to the printing mode A3 shown in FIG. 15, the unit band BA of the color image Ic is formed by two printing passes. Hence, the sub-scanning direction resolution of the color image Ic is twice as fine as the nozzle pitch, and the main scanning direction resolution thereof is the same as the highest resolution of the printer 100.

Further, as shown in FIG. 16, in the printing mode C3, the unit band BA of the white image Iw is formed by a single printing pass. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is the same as the highest resolution of the printer 100.

As described above, in the printing mode C3, two printing passes are necessary for printing the unit band BA of the color image Ic, and a single printing pass is necessary for printing the unit band BA of the white image Iw. Hence, a total of three printing passes are necessary for printing the unit band BA of the print image PI. Further, the sub-scanning direction resolution of the print image PI in the case of the color image Ic is twice as fine as the nozzle pitch, but the sub-scanning direction resolution thereof in the case of the white image Iw is the same as the nozzle pitch. In addition, the main scanning direction resolution thereof in both cases of the color image Ic and the white image Iw is the same as the highest resolution of the printer 100. Hence, in the printing mode C3, the printing speed is higher than that in the printing mode A3, and the image quality of the white image Iw is lower than that in the printing mode A3.

As described above, also in the printing system 10 of the third embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A3 in which the print image quality has priority, the number of nozzles, which constitute the nozzle group for the first image used to form the color image Ic, is equal to the number of nozzles which constitute the nozzle group for the second image used to form the white image Iw. In the printing mode C3 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C3 and A3, and the image quality of the white image Iw is better in order of the printing modes A3 and C3. Accordingly, in the printing system 10 of the embodiment, for example, in the case where a decrease in printing time is more important than suppressing deterioration in the image quality of the white image Iw, the printing mode C3 is selected. In contrast, in the case where suppressing deterioration in the image quality of the white image Iw is more important than the decrease in printing time, the printing mode A3 is selected. In such a manner, it is possible to achieve a printing process appropriate for the use and purpose thereof. As a result, in the printing system 10 of the third embodiment, when performing the printing process of forming two images on a print medium in an overlapping manner, it is possible to achieve a printing process appropriate for the use and purpose thereof while suppressing an increase in the size of the apparatus.

D. Fourth Embodiment

Figure 17:
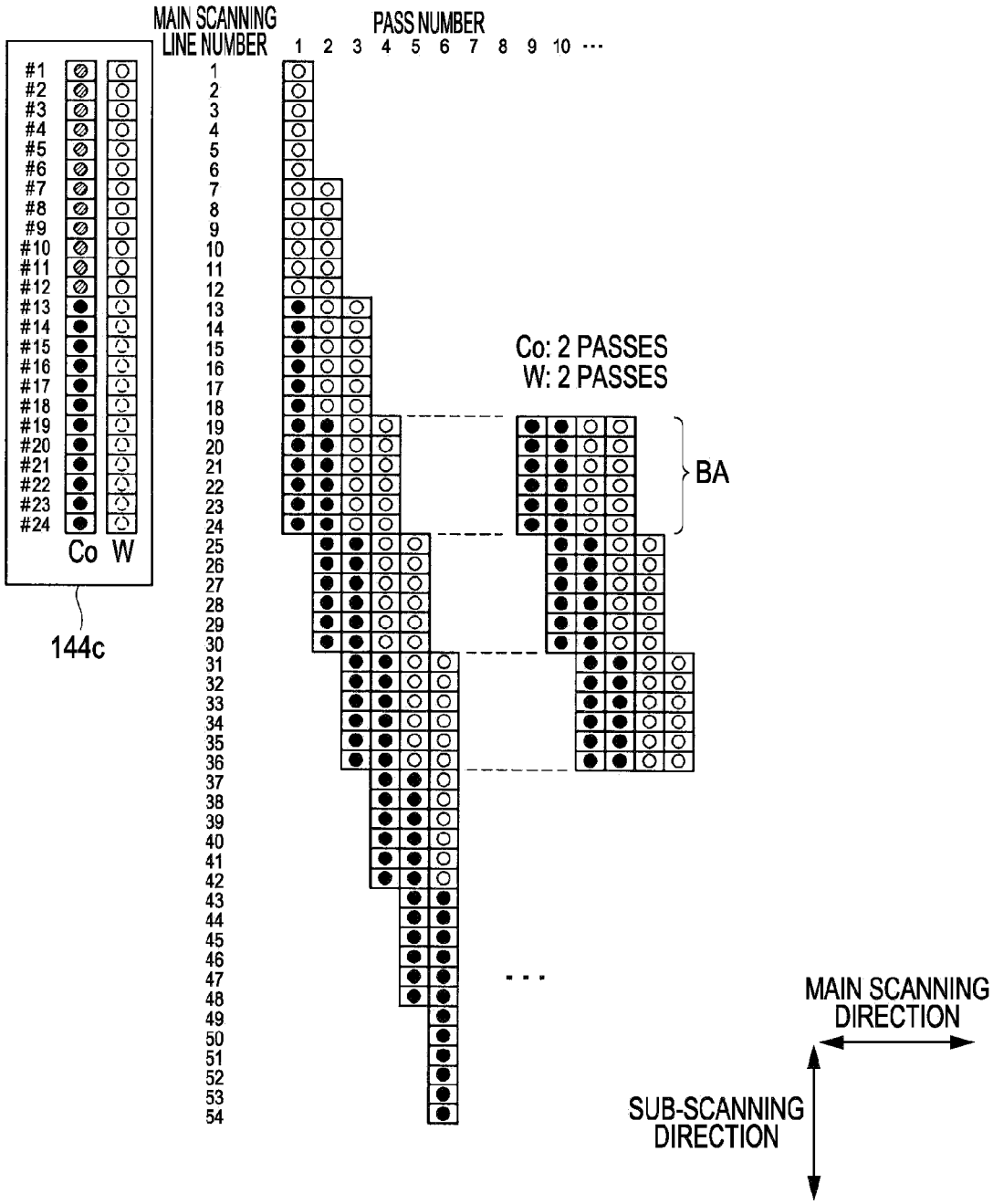
FIG. 17 is an explanatory diagram illustrating a printing method of a printing mode according to a fourth embodiment.
Figure 18:
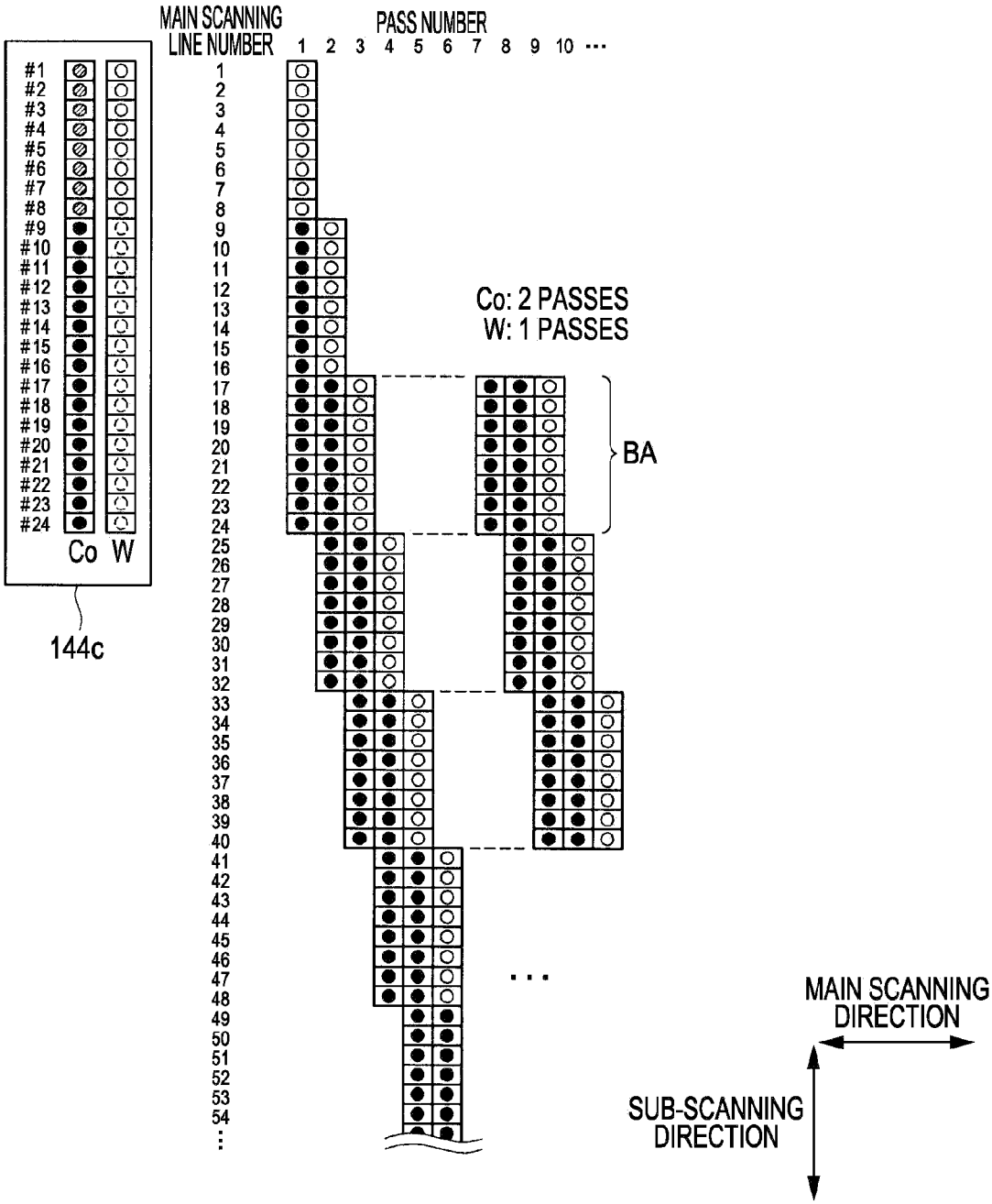
FIG. 18 is an explanatory diagram illustrating a printing method of a printing mode according to the fourth embodiment.

The printing system 10 of the fourth embodiment is able to perform the printing process of forming the color image Ic and the white image Iw on a print medium in an overlapping manner, by using two printing modes including a printing mode A4 in which the print image quality has priority and a printing mode C4 in which the printing speed has priority. In addition, the printing system 10 has the same configuration as that of the first embodiment. FIGS. 17 and 18 are explanatory diagrams illustrating printing methods in the respective printing modes of the fourth embodiment. In the fourth embodiment, each nozzle array of the print head 144*c* includes 24 nozzles, and the nozzle pitch d corresponds to a single raster.

FIG. 17 shows a printing method in the printing mode A4 in which the print image quality has priority. As shown in FIG. 17, in the printing mode A4, among the nozzles constituting the color nozzle array Co, 13th to 24th 12 nozzles (hereinafter referred to as "the nozzle group for the first image in the printing mode A4") are used to form the color image Ic, and the other nozzles are not used to form the color image Ic. Further, among the nozzles constituting the white nozzle array W, 1st to 12th 12 nozzles (hereinafter referred to as "the nozzle group for the second image in the printing mode A4") are used to form the white image Iw, and the other nozzles are not used to form the white image Iw. That is, in the printing mode A4, the number of nozzles, which are used to form the color image Ic, in the color nozzle array Co is equal to the number of nozzles, which are used to form the white image Iw, in the white nozzle array W.

As shown in FIG. 17, in the printing mode A4, the unit band BA of the color image Ic is formed by two printing passes. More specifically, in the main scanning direction, each raster is formed by two printing passes (that is, each raster is formed by using two different nozzles). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the color image Ic is the same as the nozzle pitch, and the main scanning direction resolution thereof is twice as fine as the highest resolution of the printer 100.

Further, as shown in FIG. 17, in the printing mode A4, similarly to the unit band BA of the color image Ic, the unit band BA of the white image Iw is also formed by two printing passes. Hence, the sub-scanning direction resolution of the white image Iw is the same as the nozzle pitch, and the main scanning direction resolution thereof is twice as fine as the highest resolution of the printer 100.

As described above, in the printing mode A4, two printing passes are necessary for printing the unit band BA of the color image Ic, and two printing passes are necessary for printing the unit band BA of the white image Iw. Hence, a total of four printing passes are necessary for printing the unit band BA of the print image PI. Further, the sub-scanning direction resolution of the print image PI in both cases of the color image Ic and the white image Iw is the same as the nozzle pitch, and the main scanning direction resolution thereof in both cases of the color image Ic and the white image Iw is twice as fine as the highest resolution of the printer 100.

FIG. 18 shows a printing method in the printing mode C4 in which the printing speed has priority. As shown in FIG. 18, in the printing mode C4, among the nozzles constituting the color nozzle array Co, 9th to 24th 16 nozzles (hereinafter referred to as "the nozzle group for the first image in the printing mode C4") are used to form the color image Ic, and the other nozzles are not used to form the color image Ic. Further, among the nozzles constituting the white nozzle array W, 1st to 8th 8 nozzles (hereinafter referred to as "the nozzle group for the second image in the printing mode C4") are used to form the white image Iw, and the other nozzles are not used to form the white image Iw. That is, in the printing mode C4, the number of nozzles, which are used to form the color image Ic, in the color nozzle array Co is larger than the number of nozzles, which are used to form the white image Iw, in the white nozzle array W. Accordingly, in the printing mode C4, as compared with the above-mentioned printing mode A4, the number of nozzles, which are used to form the color image Ic, is large, whereas the number of nozzles, which are used to form the white image Iw, is small.

As shown in FIG. 18, in the printing mode C4, similarly to the printing mode A4 shown in FIG. 17, the unit band BA of the color image Ic is formed by two printing passes. Hence, the sub-scanning direction resolution of the color image Ic is the same as the nozzle pitch, and the main scanning direction resolution thereof is twice as fine as the highest resolution of the printer 100.

Further, as shown in FIG. 18, in the printing mode C4, the unit band BA of the white image Iw is formed by a single printing pass. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is the same as the highest resolution of the printer 100.

As described above, in the printing mode C4, two printing passes are necessary for printing the unit band BA of the color image Ic, and a single printing pass is necessary for printing the unit band BA of the white image Iw. Hence, a total of three printing passes are necessary for printing the unit band BA of the print image PI. Further, the sub-scanning direction resolution of the print image PI in both cases of the color image Ic and the white image Iw is the same as the nozzle pitch. In contrast, the main scanning direction resolution thereof in the case of the color image Ic is twice as fine as the highest resolution of the printer 100, but the main scanning direction resolution thereof in the case of the white image Iw is the same as the highest resolution of the printer 100. Hence, in the printing mode C4, the printing speed is higher than that in the printing mode A4, and the image quality of the white image Iw is lower than that in the printing mode A4.

As described above, also in the printing system 10 of the fourth embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A4 in which the print image quality has priority, the number of nozzles, which constitute the nozzle group for the first image used to form the color image Ic, is equal to the number of nozzles which constitute the nozzle group for the second image used to form the white image Iw. In the printing mode C4 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C4 and A4, and the image quality of the white image Iw is better in order of the printing modes A4 and C4. Accordingly, in the printing system 10 of the embodiment, for example, in the case where a decrease in printing time is more important than suppressing deterioration in the image quality of the white image Iw, the printing mode C4 is selected. In contrast, in the case where suppressing deterioration in the image quality of the white image Iw is more important than the decrease in printing time, the printing mode A4 is selected. In such a manner, it is possible to achieve a printing process appropriate for the use and purpose thereof. As a result, in the printing system 10 of the fourth embodiment, when performing the printing process of forming two images on a print medium in an overlapping manner, it is possible to achieve a printing process appropriate for the use and purpose thereof while suppressing an increase in the size of the apparatus.

E. Fifth Embodiment

Figure 19:
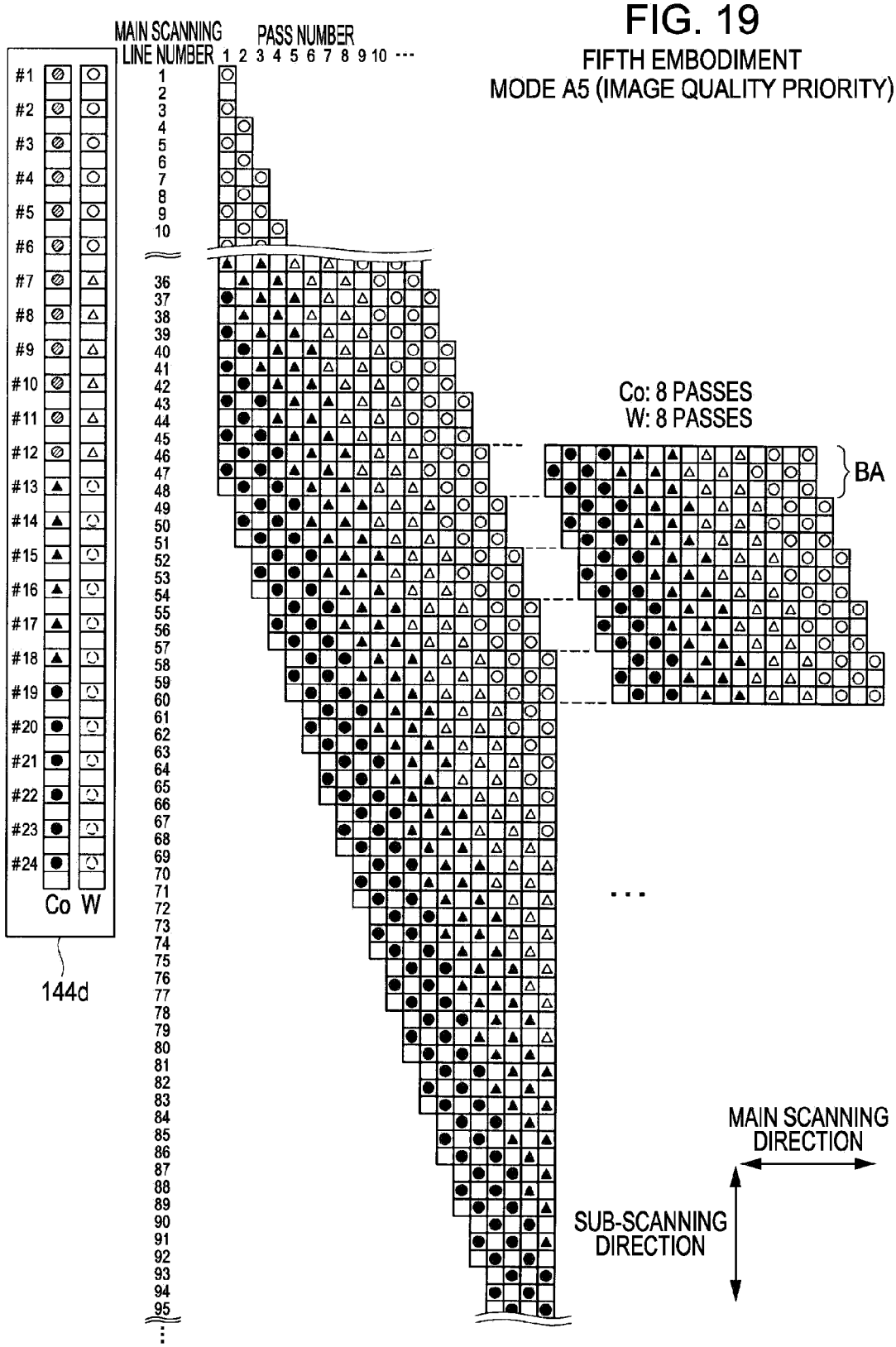
FIG. 19 is an explanatory diagram illustrating a printing method of a printing mode according to a fifth embodiment.
Figure 20:
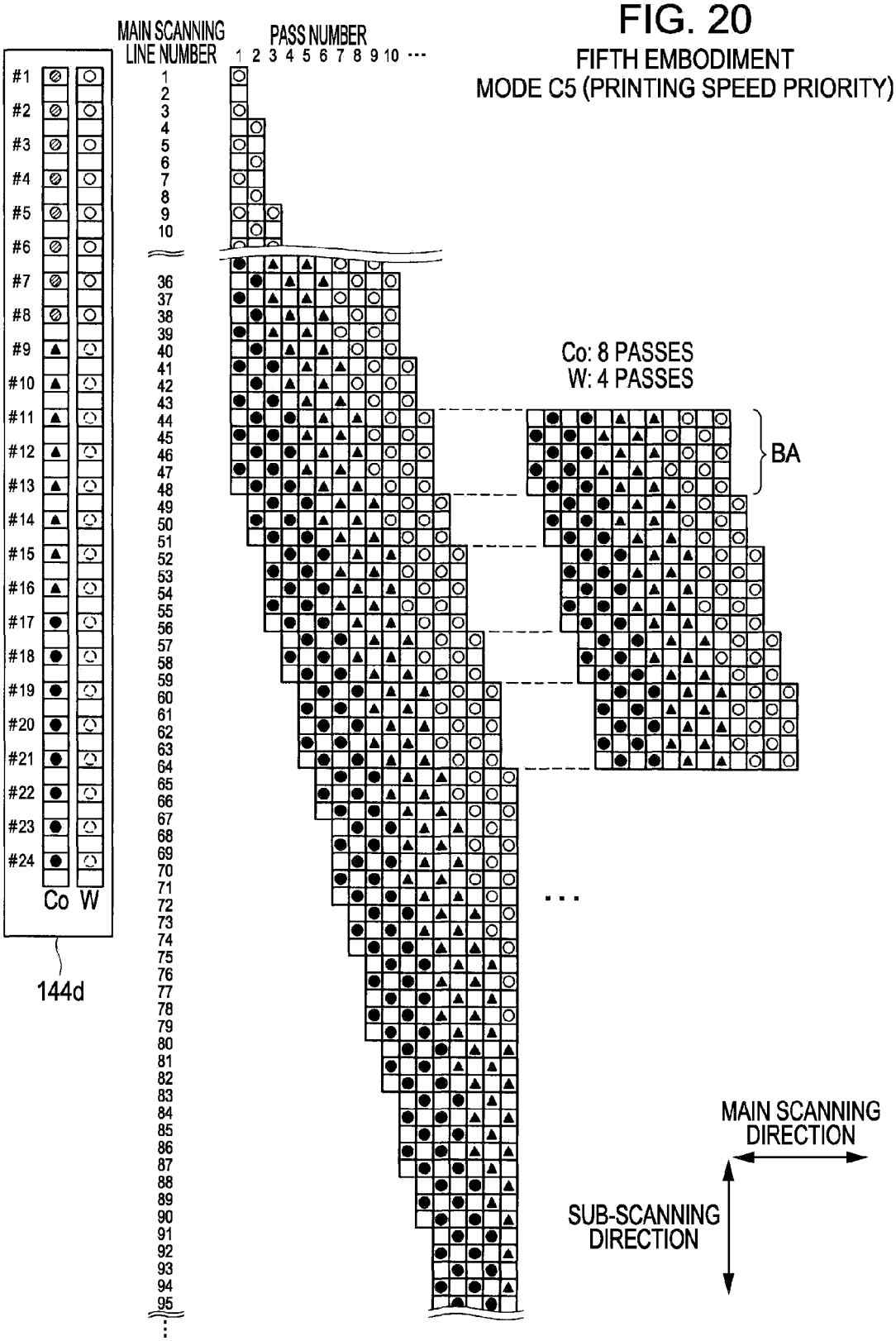
FIG. 20 is an explanatory diagram illustrating a printing method of a printing mode according to the fifth embodiment.

The printing system 10 of the fifth embodiment is able to perform the printing process of forming the color image Ic and the white image Iw on a print medium in an overlapping manner, by using two printing modes including a printing mode A5 in which the print image quality has priority and a printing mode C5 in which the printing speed has priority. In addition, the printing system 10 has the same configuration as that of the first embodiment. FIGS. 19 and 20 are explanatory diagrams illustrating printing methods in the respective printing modes of the fifth embodiment. In the fifth embodiment, each nozzle array of the print head 144*d* includes 24 nozzles, and the nozzle pitch d corresponds to two rasters.

In addition, in FIGS. 19 and 20, among the nozzles constituting the color nozzle array Co, the nozzles indicated by the black circles and black triangles are nozzles which are used to form the color image Ic, and the nozzles indicated by the hatched circles are nozzles which are not used to form the color image Ic. Further, in each drawing, among the nozzles constituting the white nozzle array W, the nozzles indicated by the solid white circles and white triangles are nozzles which are used to form the white image Iw, and the nozzles indicated by the dashed white circles are nozzles which are not used to form the white image Iw. Further, in the drawing showing the positions of the nozzle arrays in the sub-scanning direction for each printing pass in the right side of each drawing, the black circles and black triangles represent the positions of the nozzles, which are used to form the color image Ic, in the sub-scanning direction, and the white circles and white triangles represent the positions of the nozzles, which are used to form the white image Iw, in the sub-scanning direction. The signs in the drawing have the same meaning as the signs in the drawings corresponding to the following embodiments.

FIG. 19 shows a printing method in the printing mode A5 in which the print image quality has priority. As shown in FIG. 19, in the printing mode A5, among the nozzles constituting the color nozzle array Co, 13th to 24th 12 nozzles (hereinafter referred to as "the nozzle group for the first image in the printing mode A5") are used to form the color image Ic, and the other nozzles are not used to form the color image Ic. Further, among the nozzles constituting the white nozzle array W, 1st to 12th 12 nozzles (hereinafter referred to as "the nozzle group for the second image in the printing mode A5") are used to form the white image Iw, and the other nozzles are not used to form the white image Iw. That is, in the printing mode A5, the number of nozzles, which are used to form the color image Ic, in the color nozzle array Co is equal to the number of nozzles, which are used to form the white image Iw, in the white nozzle array W.

As shown in FIG. 19, in the printing mode A5, the unit band BA of the color image Ic is formed by eight printing passes. More specifically, in the main scanning direction, each raster is formed by four printing passes (that is, each raster is formed by using four different nozzles). The main scanning direction resolution in each printing pass is a half of the highest resolution of the printer 100. Further, among the four passes, two passes are printing passes through which dots are formed by the nozzles (for example, the nozzles indicated by the black circles in the drawing) belonging to one of two parts of the nozzle group for the first image in a case where the nozzle group is divided into two in the sub-scanning direction. In addition, the remaining two passes are printing passes through which dots are formed by the nozzles (for example, the nozzles indicated by the black triangles in the drawing) belonging to the other one of two parts of the nozzle group for the first image in a case where the nozzle group is divided into two in the sub-scanning direction. Further, in the sub-scanning direction, between plural dots formed in each printing pass, dots formed by another single printing pass are disposed. Hence, the sub-scanning direction resolution of the color image Ic is twice as fine as the nozzle pitch, and the main scanning direction resolution thereof is twice as fine as the highest resolution of the printer 100.

Further, as shown in FIG. 19, in the printing mode A5, similarly to the unit band BA of the color image Ic, the unit band BA of the white image Iw is also formed by eight printing passes. Hence, the sub-scanning direction resolution of the white image Iw is twice as fine as the nozzle pitch, and the main scanning direction resolution thereof is twice as fine as the highest resolution of the printer 100.

As described above, in the printing mode A5, eight printing passes are necessary for printing the unit band BA of the color image Ic, and eight printing passes are necessary for printing the unit band BA of the white image Iw. Hence, a total of 16 printing passes are necessary for printing the unit band BA of the print image PI. Further, the sub-scanning direction resolution of the print image PI in both cases of the color image Ic and the white image Iw is twice as fine as the nozzle pitch, and the main scanning direction resolution thereof in both cases of the color image Ic and the white image Iw is twice as fine as the highest resolution of the printer 100.

FIG. 20 shows a printing method in the printing mode C5 in which the printing speed has priority. As shown in FIG. 20, in the printing mode C5, among the nozzles constituting the color nozzle array Co, 9th to 24th 16 nozzles (hereinafter referred to as "the nozzle group for the first image in the printing mode C5") are used to form the color image Ic, and the other nozzles are not used to form the color image Ic. Further, among the nozzles constituting the white nozzle array W, 1st to 8th 8 nozzles (hereinafter referred to as "the nozzle group for the second image in the printing mode C5") are used to form the white image Iw, and the other nozzles are not used to form the white image Iw. That is, in the printing mode C5, the number of nozzles, which are used to form the color image Ic, in the color nozzle array Co is larger than the number of nozzles, which are used to form the white image Iw, in the white nozzle array W. Accordingly, in the printing mode C5, as compared with the above-mentioned printing mode A5, the number of nozzles, which are used to form the color image Ic, is large, whereas the number of nozzles, which are used to form the white image Iw, is small.

As shown in FIG. 20, in the printing mode C5, similarly to the printing mode A5 shown in FIG. 19, the unit band BA of the color image Ic is formed by eight printing passes. Hence, the sub-scanning direction resolution of the color image Ic is twice as fine as the nozzle pitch, and the main scanning direction resolution thereof is twice as fine as the highest resolution of the printer 100.

Further, as shown in FIG. 20, in the printing mode C5, the unit band BA of the white image Iw is formed by four printing passes. More specifically, in the main scanning direction, each raster is formed by two printing passes (that is, each raster is formed by using two different nozzles). The main scanning direction resolution in each printing pass is the same as the highest resolution of the printer 100. Further, in the sub-scanning direction, between plural dots formed in each printing pass, dots formed by another single printing pass are disposed. Hence, the sub-scanning direction resolution of the white image Iw is twice as fine as the nozzle pitch, and the main scanning direction resolution thereof is twice as fine as the highest resolution of the printer 100.

As described above, in the printing mode C5, eight printing passes are necessary for printing the unit band BA of the color image Ic, and four printing passes are necessary for printing the unit band BA of the white image Iw. Hence, a total of 12 printing passes are necessary for printing the unit band BA of the print image PI. Further, the sub-scanning direction resolution of the print image PI in both cases of the color image Ic and the white image Iw is twice as fine as the nozzle pitch. In addition, the main scanning direction resolution thereof in the case of the color image Ic is twice as fine as the highest resolution of the printer 100, but the main scanning direction resolution thereof in the case of the white image Iw is twice as fine as the highest resolution of the printer 100. Hence, in the printing mode C5, the printing speed is higher than that in the printing mode A5, and the image quality of the white image Iw is lower than that in the printing mode A5.

As described above, also in the printing system 10 of the fifth embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A5 in which the print image quality has priority, the number of nozzles, which constitute the nozzle group for the first image used to form the color image Ic, is equal to the number of nozzles which constitute the nozzle group for the second image used to form the white image Iw. In the printing mode C5 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C5 and A5, and the image quality of the white image Iw is better in order of the printing modes A5 and C5. Accordingly, in the printing system 10 of the embodiment, for example, in the case where a decrease in printing time is more important than suppressing deterioration in the image quality of the white image Iw, the printing mode C5 is selected. In contrast, in the case where suppressing deterioration in the image quality of the white image Iw is more important than the decrease in printing time, the printing mode A5 is selected. In such a manner, it is possible to achieve a printing process appropriate for the use and purpose thereof. As a result, in the printing system 10 of the fifth embodiment, when performing the printing process of forming two images on a print medium in an overlapping manner, it is possible to achieve a printing process appropriate for the use and purpose thereof while suppressing an increase in the size of the apparatus.

F. Sixth Embodiment

Figure 21:
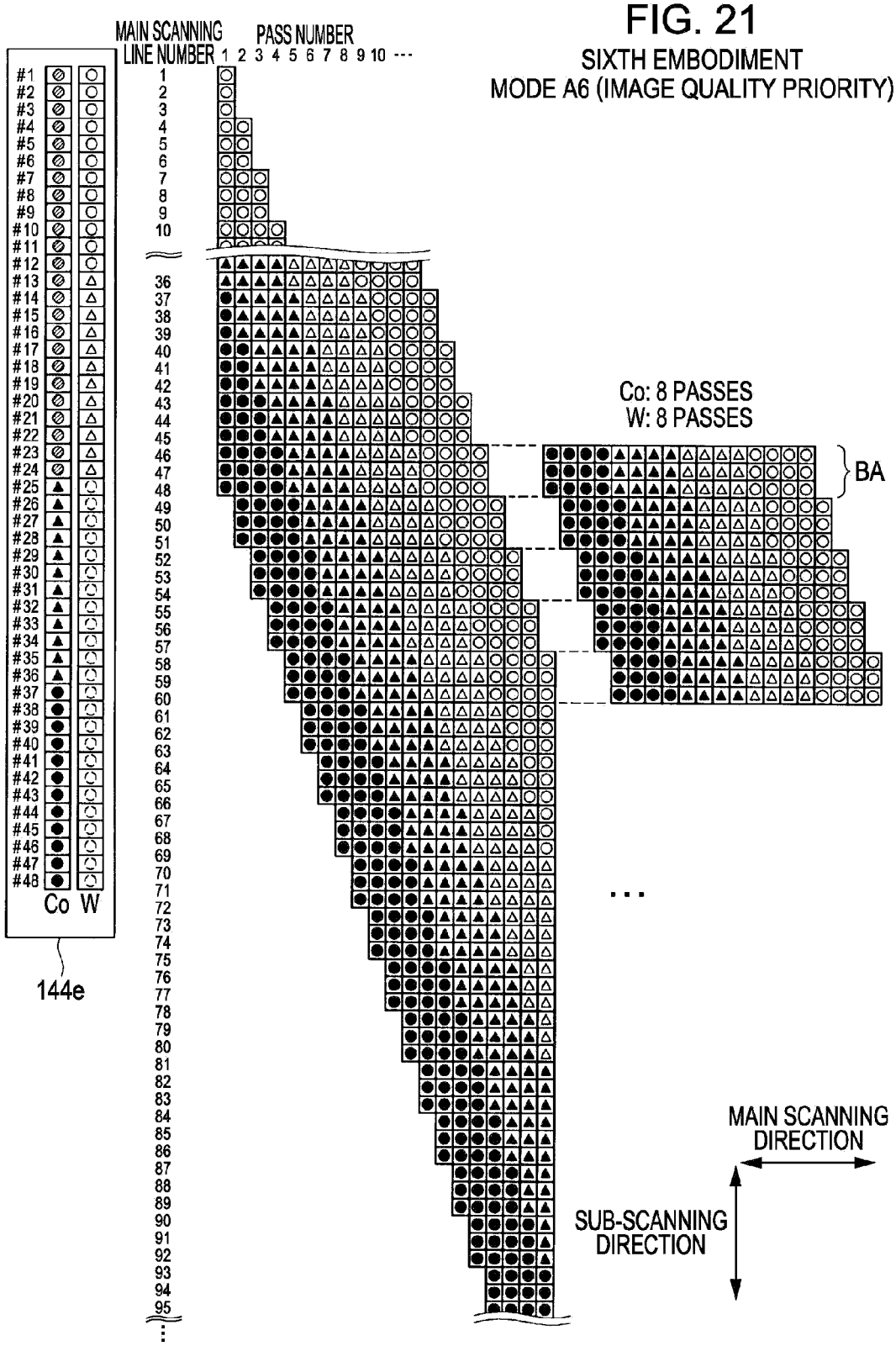
FIG. 21 is an explanatory diagram illustrating a printing method of a printing mode according to a sixth embodiment.
Figure 22:
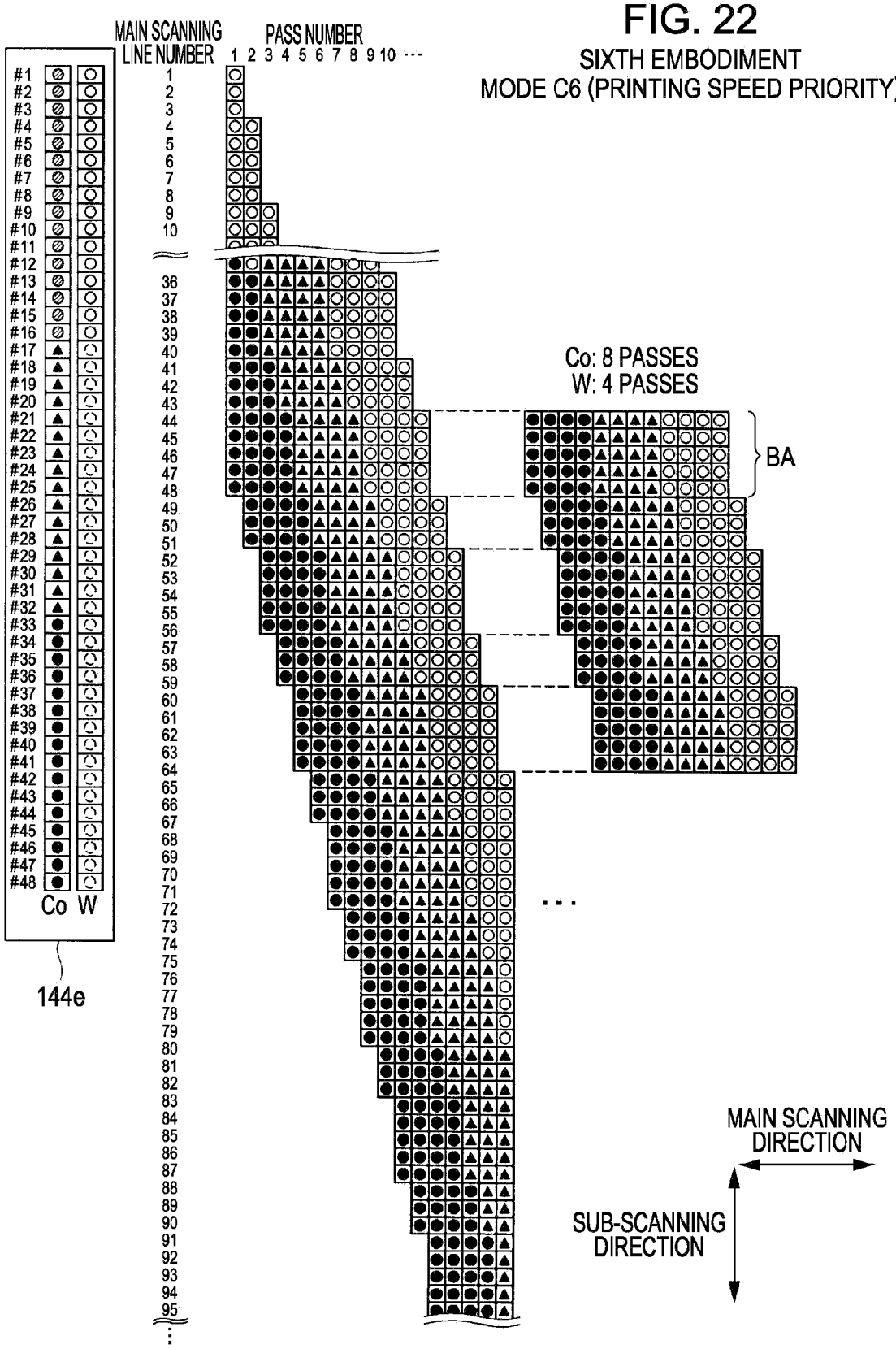
FIG. 22 is an explanatory diagram illustrating a printing method of a printing mode according to the sixth embodiment.

The printing system 10 of the sixth embodiment is able to perform the printing process of forming the color image Ic and the white image Iw on a print medium in an overlapping manner, by using two printing modes including a printing mode A6 in which the print image quality has priority and a printing mode C6 in which the printing speed has priority. In addition, the printing system 10 has the same configuration as that of the first embodiment. FIGS. 21 and 22 are explanatory diagrams illustrating printing methods in the respective printing modes of the sixth embodiment. In the sixth embodiment, each nozzle array of the print head 144*e* includes 48 nozzles, and the nozzle pitch d corresponds to a single raster.

FIG. 21 shows a printing method in the printing mode A6 in which the print image quality has priority. As shown in FIG. 21, in the printing mode A6, among the nozzles constituting the color nozzle array Co, 25th to 48th 24 nozzles (hereinafter referred to as "the nozzle group for the first image in the printing mode A6") are used to form the color image Ic, and the other nozzles are not used to form the color image Ic. Further, among the nozzles constituting the white nozzle array W, 1st to 24th 24 nozzles (hereinafter referred to as "the nozzle group for the second image in the printing mode A6") are used to form the white image Iw, and the other nozzles are not used to form the white image Iw. That is, in the printing mode A6, the number of nozzles, which are used to form the color image Ic, in the color nozzle array Co is equal to the number of nozzles, which are used to form the white image Iw, in the white nozzle array W.

As shown in FIG. 21, in the printing mode A6, the unit band BA of the color image Ic is formed by eight printing passes. More specifically, in the main scanning direction, each raster is formed by eight printing passes (that is, each raster is formed by using eight different nozzles). The main scanning direction resolution in each printing pass is a half of the highest resolution of the printer 100. Further, among the eight passes, four passes are printing passes through which dots are formed by the nozzles (for example, the nozzles indicated by the black circles in the drawing) belonging to one of two parts of the nozzle group for the first image in a case where the nozzle group is divided into two in the sub-scanning direction. In addition, the remaining four passes are printing passes through which dots are formed by the nozzles (for example, the nozzles indicated by the black triangles in the drawing) belonging to the other one of two parts of the nozzle group for the first image in a case where the nozzle group is divided into two in the sub-scanning direction. Further, in the sub-scanning direction, between plural dots formed in each printing pass, dots formed by another printing pass are not disposed. Hence, the sub-scanning direction resolution of the color image Ic is the same as the nozzle pitch, and the main scanning direction resolution thereof is four times as fine as the highest resolution of the printer 100.

Further, as shown in FIG. 21, in the printing mode A6, similarly to the unit band BA of the color image Ic, the unit band BA of the white image Iw is also formed by eight printing passes. Hence, the sub-scanning direction resolution of the white image Iw is the same as the nozzle pitch, and the main scanning direction resolution thereof is four times as fine as the highest resolution of the printer 100.

As described above, in the printing mode A6, eight printing passes are necessary for printing the unit band BA of the color image Ic, and eight printing passes are necessary for printing the unit band BA of the white image Iw. Hence, a total of 16 printing passes are necessary for printing the unit band BA of the print image PI. Further, the sub-scanning direction resolution of the print image PI in both cases of the color image Ic and the white image Iw is the same as the nozzle pitch, and the main scanning direction resolution thereof in both cases of the color image Ic and the white image Iw is four times as fine as the highest resolution of the printer 100.

FIG. 22 shows a printing method in the printing mode C6 in which the printing speed has priority. As shown in FIG. 22, in the printing mode C6, among the nozzles constituting the color nozzle array Co, 17th to 48th 32 nozzles (hereinafter referred to as "the nozzle group for the first image in the printing mode C6") are used to form the color image Ic, and the other nozzles are not used to form the color image Ic. Further, among the nozzles constituting the white nozzle array W, 1st to 16th 16 nozzles (hereinafter referred to as "the nozzle group for the second image in the printing mode C6") are used to form the white image Iw, and the other nozzles are not used to form the white image Iw. That is, in the printing mode C6, the number of nozzles, which are used to form the color image Ic, in the color nozzle array Co is larger than the number of nozzles, which are used to form the white image Iw, in the white nozzle array W. Accordingly, in the printing mode C6, as compared with the above-mentioned printing mode A6, the number of nozzles, which are used to form the color image Ic, is large, whereas the number of nozzles, which are used to form the white image Iw, is small.

As shown in FIG. 22, in the printing mode C6, similarly to the printing mode A6 shown in FIG. 21, the unit band BA of the color image Ic is formed by eight printing passes. Hence, the sub-scanning direction resolution of the color image Ic is the same as the nozzle pitch, and the main scanning direction resolution thereof is four times as fine as the highest resolution of the printer 100.

Further, as shown in FIG. 22, in the printing mode C6, the unit band BA of the white image Iw is formed by four printing passes. More specifically, in the main scanning direction, each raster is formed by four printing passes (that is, each raster is formed by using four different nozzles). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is four times as fine as the highest resolution of the printer 100.

As described above, in the printing mode C6, eight printing passes are necessary for printing the unit band BA of the color image Ic, and four printing passes are necessary for printing the unit band BA of the white image Iw. Hence, a total of 12 printing passes are necessary for printing the unit band BA of the print image PI. Further, the sub-scanning direction resolution of the print image PI in both cases of the color image Ic and the white image Iw is the same as the nozzle pitch. In contrast, the main scanning direction resolution thereof in the case of the color image Ic is four times as fine as the highest resolution of the printer 100, but the main scanning direction resolution thereof in the case of the white image Iw is four times as fine as the highest resolution of the printer 100. Hence, in the printing mode C6, the printing speed is higher than that in the printing mode A6, and the image quality of the white image Iw is lower than that in the printing mode A6.

As described above, also in the printing system 10 of the sixth embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A6 in which the print image quality has priority, the number of nozzles, which constitute the nozzle group for the first image used to form the color image Ic, is equal to the number of nozzles which constitute the nozzle group for the second image used to form the white image Iw. In the printing mode C6 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C6 and A6, and the image quality of the white image Iw is better in order of the printing modes A6 and C6. Accordingly, in the printing system 10 of the embodiment, for example, in the case where a decrease in printing time is more important than suppressing deterioration in the image quality of the white image Iw, the printing mode C6 is selected. In contrast, in the case where suppressing deterioration in the image quality of the white image Iw is more important than the decrease in printing time, the printing mode A6 is selected. In such a manner, it is possible to achieve a printing process appropriate for the use and purpose thereof. As a result, in the printing system 10 of the sixth embodiment, when performing the printing process of forming two images on a print medium in an overlapping manner, it is possible to achieve a printing process appropriate for the use and purpose thereof while suppressing an increase in the size of the apparatus.

G. Seventh Embodiment

Figure 23:
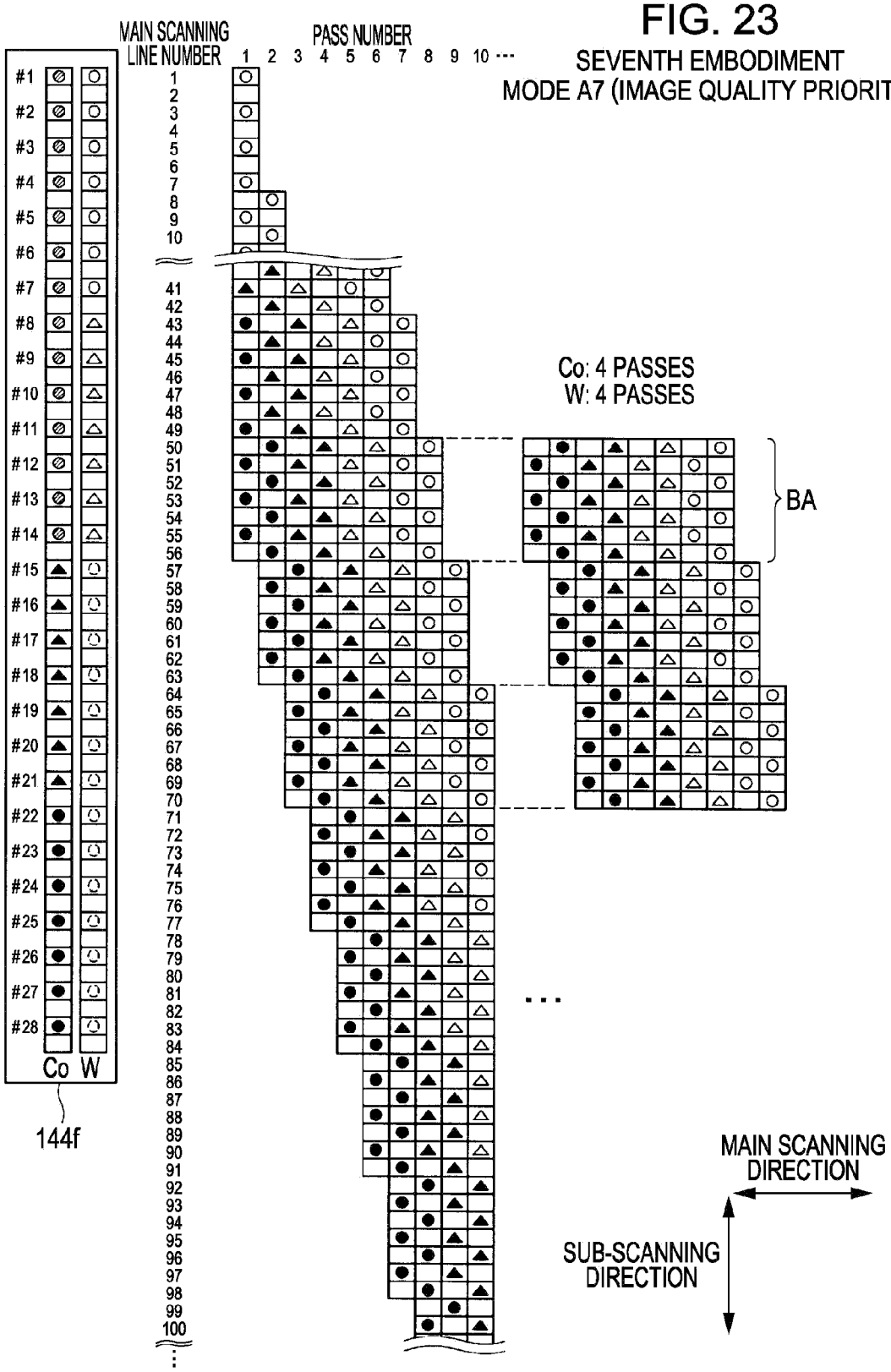
FIG. 23 is an explanatory diagram illustrating a printing method of a printing mode according to a seventh embodiment.
Figure 24:
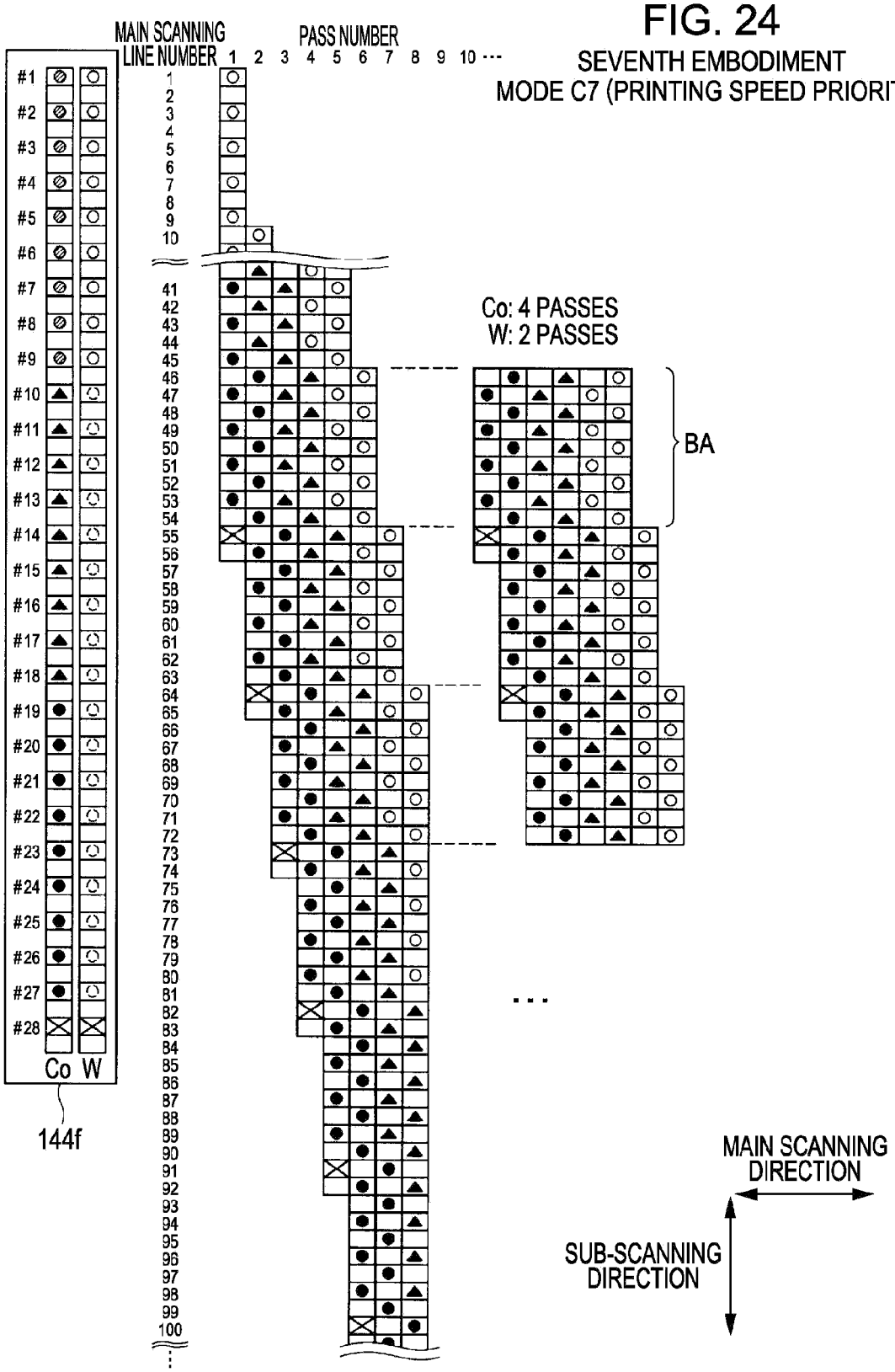
FIG. 24 is an explanatory diagram illustrating a printing method of a printing mode according to the seventh embodiment.

The printing system 10 of the seventh embodiment is able to perform the printing process of forming the color image Ic and the white image Iw on a print medium in an overlapping manner, by using two printing modes including a printing mode A7 in which the print image quality has priority and a printing mode C7 in which the printing speed has priority. In addition, the printing system 10 has the same configuration as that of the first embodiment. FIGS. 23 and 24 are explanatory diagrams illustrating printing methods in the respective printing modes of the seventh embodiment. In the seventh embodiment, each nozzle array of the print head 144*f* includes 28 nozzles, and the nozzle pitch d corresponds to two rasters.

FIG. 23 shows a printing method in the printing mode A7 in which the print image quality has priority. As shown in FIG. 23, in the printing mode A7, among the nozzles constituting the color nozzle array Co, 15th to 28th 14 nozzles (hereinafter referred to as "the nozzle group for the first image in the printing mode A7") are used to form the color image Ic, and the other nozzles are not used to form the color image Ic. Further, among the nozzles constituting the white nozzle array W, 1st to 14th 14 nozzles (hereinafter referred to as "the nozzle group for the second image in the printing mode A7") are used to form the white image Iw, and the other nozzles are not used to form the white image Iw. That is, in the printing mode A7, the number of nozzles, which are used to form the color image Ic, in the color nozzle array Co is equal to the number of nozzles, which are used to form the white image Iw, in the white nozzle array W.

As shown in FIG. 23, in the printing mode A7, the unit band BA of the color image Ic is formed by four printing passes. More specifically, in the main scanning direction, each raster is formed by two printing passes (that is, each raster is formed by using two different nozzles). The main scanning direction resolution in each printing pass is a half of the highest resolution of the printer 100. Further, among the two passes, one pass is a printing pass through which dots are formed by the nozzles (for example, the nozzles indicated by the black circles in the drawing) belonging to one of two parts of the nozzle group for the first image in a case where the nozzle group is divided into two in the sub-scanning direction. In addition, the remaining one pass is a printing pass through which dots are formed by the nozzles (for example, the nozzles indicated by the black triangles in the drawing) belonging to the other one of two parts of the nozzle group for the first image in a case where the nozzle group is divided into two in the sub-scanning direction. Further, in the sub-scanning direction, between plural dots formed in each printing pass, dots formed by another single printing pass are disposed. Hence, the sub-scanning direction resolution of the color image Ic is twice as fine as the nozzle pitch, and the main scanning direction resolution thereof is the same as the highest resolution of the printer 100.

Further, as shown in FIG. 23, in the printing mode A7, similarly to the unit band BA of the color image Ic, the unit band BA of the white image Iw is formed by four printing passes. Hence, the sub-scanning direction resolution of the white image Iw is twice as fine as the nozzle pitch, and the main scanning direction resolution thereof is the same as the highest resolution of the printer 100.

As described above, in the printing mode A7, four printing passes are necessary for printing the unit band BA of the color image Ic, and four printing passes are necessary for printing the unit band BA of the white image Iw. Hence, a total of eight printing passes are necessary for printing the unit band BA of the print image PI. Further, the sub-scanning direction resolution of the print image PI in both cases of the color image Ic and the white image Iw is twice as fine as the nozzle pitch, and the main scanning direction resolution thereof in both cases of the color image Ic and the white image Iw is the same as the highest resolution of the printer 100.

FIG. 24 shows a printing method in the printing mode C7 in which the printing speed has priority. As shown in FIG. 24, in the printing mode C7, among the nozzles constituting the color nozzle array Co, 10th to 27th 18 nozzles (hereinafter referred to as "the nozzle group for the first image in the printing mode C7") are used to form the color image Ic, and the other nozzles are not used to form the color image Ic. Further, among the nozzles constituting the white nozzle array W, 1st to 9th 9 nozzles (hereinafter referred to as "the nozzle group for the second image in the printing mode C7") are used to form the white image Iw, and the other nozzles are not used to form the white image Iw. Further, among the nozzles constituting the color nozzle array Co and the white nozzle array W, the 28th nozzle indicated by X is not used to form any of the color image Ic and the white image Iw. That is, in the printing mode C7, the number of nozzles, which are used to form the color image Ic, in the color nozzle array Co is larger than the number of nozzles, which are used to form the white image Iw, in the white nozzle array W. Accordingly, in the printing mode C7, as compared with the above-mentioned printing mode A7, the number of nozzles, which are used to form the color image Ic, is large, whereas the number of nozzles, which are used to form the white image Iw, is small.

As shown in FIG. 24, in the printing mode C7, similarly to the printing mode A7 shown in FIG. 23, the unit band BA of the color image Ic is formed by four printing passes. Hence, the sub-scanning direction resolution of the color image Ic is twice as fine as the nozzle pitch, and the main scanning direction resolution thereof is the same as the highest resolution of the printer 100.

Further, as shown in FIG. 24, in the printing mode C7, the unit band BA of the white image Iw is formed by two printing passes. More specifically, in the main scanning direction, each raster is formed by a single printing pass (that is, each raster is formed by using only a single nozzle). The main scanning direction resolution in each printing pass is the same as the highest resolution of the printer 100. Further, in the sub-scanning direction, between plural dots formed in each printing pass, dots formed by another single printing pass are disposed. Hence, the sub-scanning direction resolution of the white image Iw is twice as fine as the nozzle pitch, and the main scanning direction resolution thereof is the same as the highest resolution of the printer 100.

As described above, in the printing mode C7, four printing passes are necessary for printing the unit band BA of the color image Ic, and two printing passes are necessary for printing the unit band BA of the white image Iw. Hence, a total of six printing passes are necessary for printing the unit band BA of the print image PI. Further, the sub-scanning direction resolution of the print image PI in both cases of the color image Ic and the white image Iw is twice as fine as the nozzle pitch. In contrast, the main scanning direction resolution thereof in the case of the color image Ic is the same as the highest resolution of the printer 100, and the main scanning direction resolution thereof in the case of the white image Iw is the same as the highest resolution of the printer 100. Hence, in the printing mode C7, the printing speed is higher than that in the printing mode A7, and the image quality of the white image Iw is lower than that in the printing mode A7.

As described above, also in the printing system 10 of the seventh embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A7 in which the print image quality has priority, the number of nozzles, which constitute the nozzle group for the first image used to form the color image Ic, is equal to the number of nozzles which constitute the nozzle group for the second image used to form the white image Iw. In the printing mode C7 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C7 and A7, and the image quality of the white image Iw is better in order of the printing modes A7 and C7. Accordingly, in the printing system 10 of the embodiment, for example, in the case where a decrease in printing time is more important than suppressing deterioration in the image quality of the white image Iw, the printing mode C7 is selected. In contrast, in the case where suppressing deterioration in the image quality of the white image Iw is more important than the decrease in printing time, the printing mode A7 is selected. In such a manner, it is possible to achieve a printing process appropriate for the use and purpose thereof. As a result, in the printing system 10 of the seventh embodiment, when performing the printing process of forming two images on a print medium in an overlapping manner, it is possible to achieve a printing process appropriate for the use and purpose thereof while suppressing an increase in the size of the apparatus.

H. Eighth Embodiment

Figure 25:
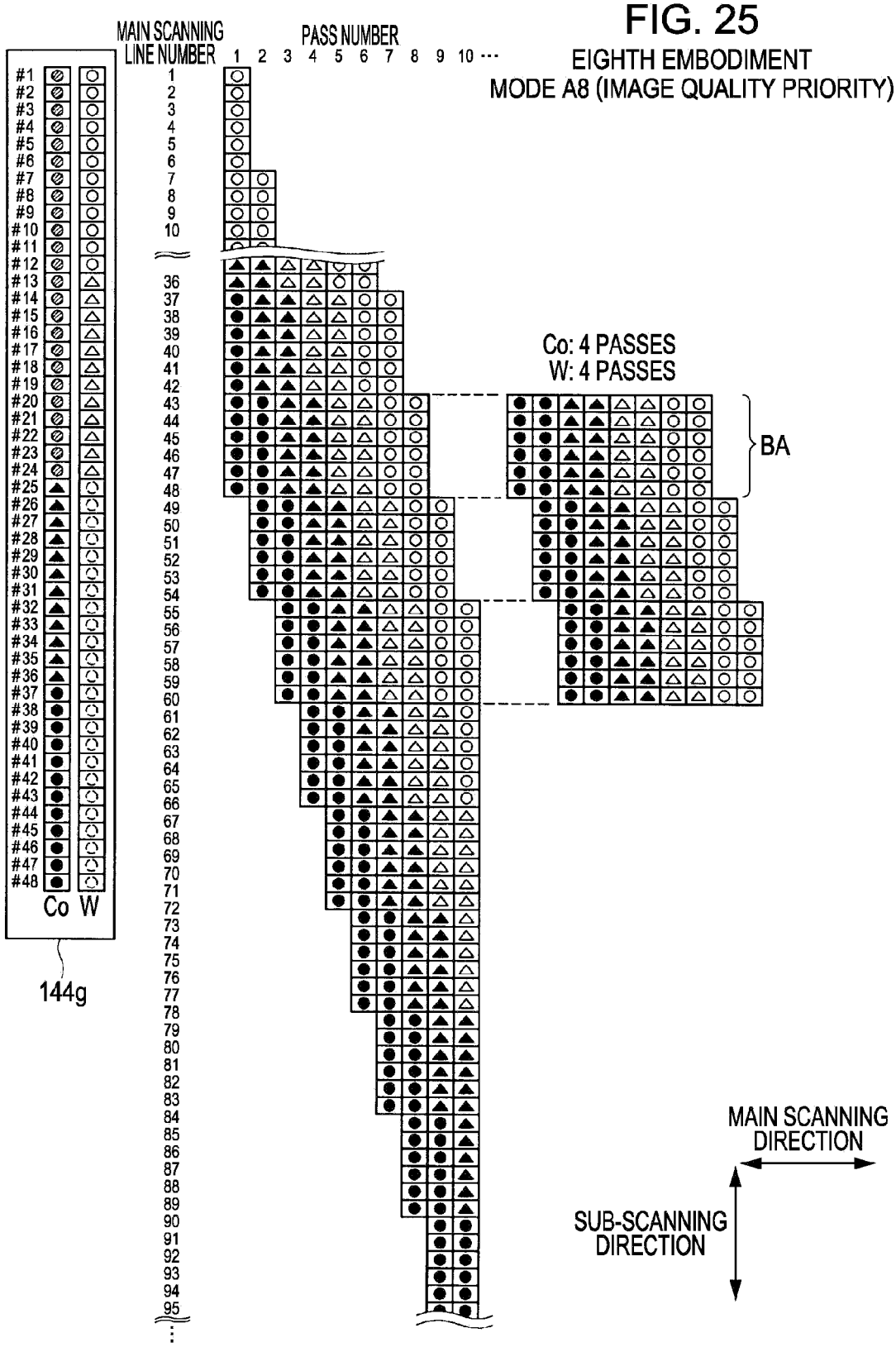
FIG. 25 is an explanatory diagram illustrating a printing method of a printing mode according to an eighth embodiment.
Figure 26:
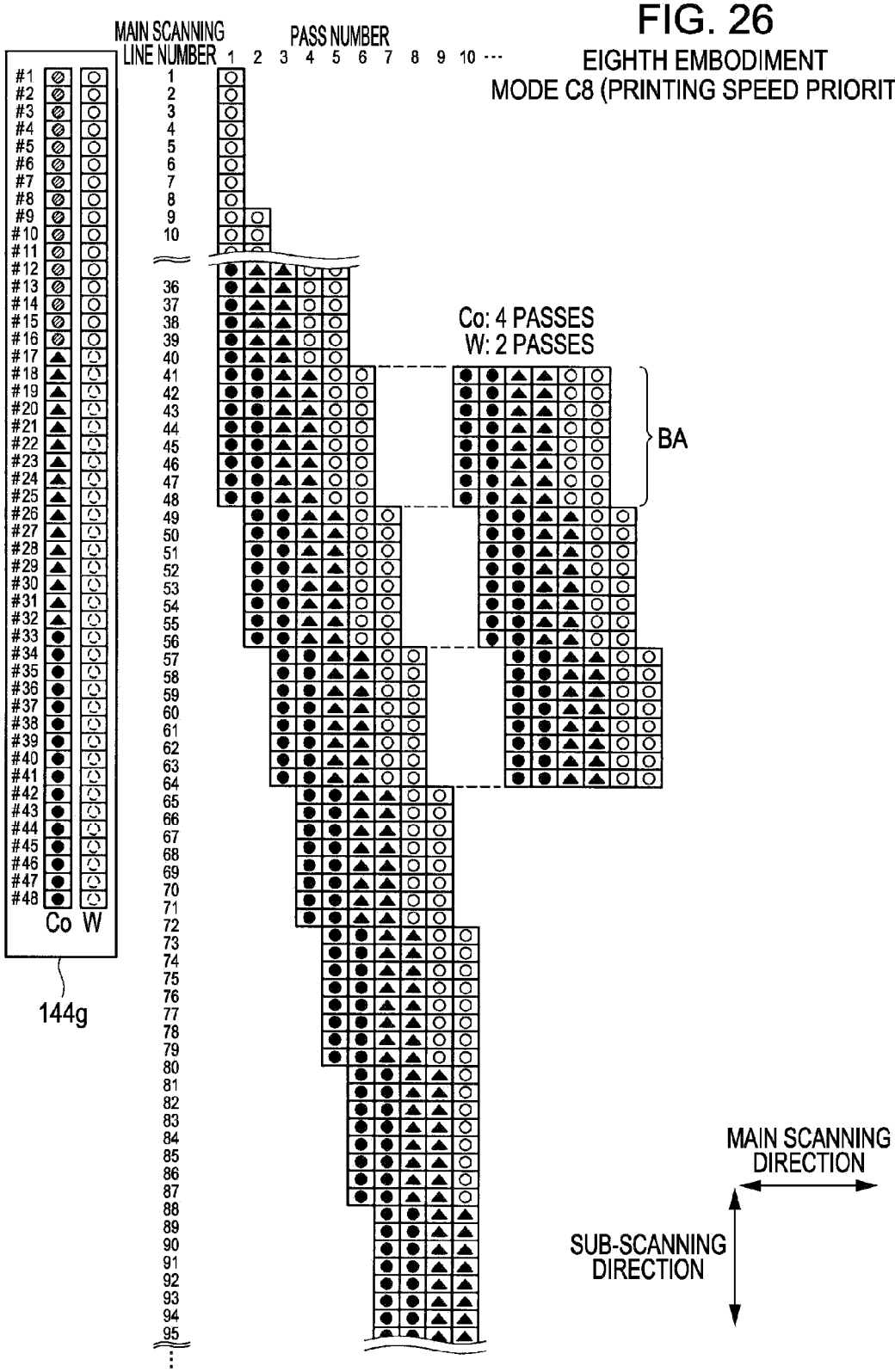
FIG. 26 is an explanatory diagram illustrating a printing method of a printing mode according to the eighth embodiment.

The printing system 10 of the eighth embodiment is able to perform the printing process of forming the color image Ic and the white image Iw on a print medium in an overlapping manner, by using two printing modes including a printing mode A8 in which the print image quality has priority and a printing mode C8 in which the printing speed has priority. In addition, the printing system 10 has the same configuration as that of the first embodiment. FIGS. 25 and 26 are explanatory diagrams illustrating printing methods in the respective printing modes of the eighth embodiment. In the eighth embodiment, each nozzle array of the print head 144*g* includes 48 nozzles, and the nozzle pitch d corresponds to a single raster.

FIG. 25 shows a printing method in the printing mode A8 in which the print image quality has priority. As shown in FIG. 25, in the printing mode A8, among the nozzles constituting the color nozzle array Co, 25th to 48th 24 nozzles (hereinafter referred to as "the nozzle group for the first image in the printing mode A8") are used to form the color image Ic, and the other nozzles are not used to form the color image Ic. Further, among the nozzles constituting the white nozzle array W, 1st to 24th 24 nozzles (hereinafter referred to as "the nozzle group for the second image in the printing mode A8") are used to form the white image Iw, and the other nozzles are not used to form the white image Iw. That is, in the printing mode A8, the number of nozzles, which are used to form the color image Ic, in the color nozzle array Co is equal to the number of nozzles, which are used to form the white image Iw, in the white nozzle array W.

As shown in FIG. 25, in the printing mode A8, the unit band BA of the color image Ic is formed by four printing passes. More specifically, in the main scanning direction, each raster is formed by four printing passes (that is, each raster is formed by using four different nozzles). The main scanning direction resolution in each printing pass is a half of the highest resolution of the printer 100. Further, among the four passes, two passes are printing passes through which dots are formed by the nozzles (for example, the nozzles indicated by the black circles in the drawing) belonging to one of two parts of the nozzle group for the first image in a case where the nozzle group is divided into two in the sub-scanning direction. In addition, the remaining two passes are printing passes through which dots are formed by the nozzles (for example, the nozzles indicated by the black triangles in the drawing) belonging to the other one of two parts of the nozzle group for the first image in a case where the nozzle group is divided into two in the sub-scanning direction. Further, in the sub-scanning direction, between plural dots formed in each printing pass, dots formed by another printing pass are not disposed. Hence, the sub-scanning direction resolution of the color image Ic is the same as the nozzle pitch, and the main scanning direction resolution thereof is twice as fine as the highest resolution of the printer 100.

Further, as shown in FIG. 25, in the printing mode A8, similarly to the unit band BA of the color image Ic, the unit band BA of the white image Iw is formed by four printing passes. Hence, the sub-scanning direction resolution of the white image Iw is the same as the nozzle pitch, and the main scanning direction resolution thereof is twice as fine as the highest resolution of the printer 100.

As described above, in the printing mode A8, four printing passes are necessary for printing the unit band BA of the color image Ic, and four printing passes are necessary for printing the unit band BA of the white image Iw. Hence, a total of eight printing passes are necessary for printing the unit band BA of the print image PI. Further, the sub-scanning direction resolution of the print image PI in both cases of the color image Ic and the white image Iw is the same as the nozzle pitch, and the main scanning direction resolution thereof in both cases of the color image Ic and the white image Iw is twice as fine as the highest resolution of the printer 100.

FIG. 26 shows a printing method in the printing mode C8 in which the printing speed has priority. As shown in FIG. 26, in the printing mode C8, among the nozzles constituting the color nozzle array Co, 17th to 48th 32 nozzles (hereinafter referred to as "the nozzle group for the first image in the printing mode C8") are used to form the color image Ic, and the other nozzles are not used to form the color image Ic. Further, among the nozzles constituting the white nozzle array W, 1st to 16th 16 nozzles (hereinafter referred to as "the nozzle group for the second image in the printing mode C8") are used to form the white image Iw, and the other nozzles are not used to form the white image Iw. That is, in the printing mode C8, the number of nozzles, which are used to form the color image Ic, in the color nozzle array Co is larger than the number of nozzles, which are used to form the white image Iw, in the white nozzle array W. Accordingly, in the printing mode C8, as compared with the above-mentioned printing mode A8, the number of nozzles, which are used to form the color image Ic, is large, whereas the number of nozzles, which are used to form the white image Iw, is small.

As shown in FIG. 26, in the printing mode C8, similarly to the printing mode A8 shown in FIG. 25, the unit band BA of the color image Ic is formed by four printing passes. Hence, the sub-scanning direction resolution of the color image Ic is the same as the nozzle pitch, and the main scanning direction resolution thereof is twice as fine as the highest resolution of the printer 100.

Further, as shown in FIG. 26, in the printing mode C8, the unit band BA of the white image Iw is formed by two printing passes. More specifically, in the main scanning direction, each raster is formed by two printing passes (that is, each raster is formed by using two different nozzles). The main scanning direction resolution in each printing pass is the same as the highest resolution of the printer 100. Further, in the sub-scanning direction, between plural dots formed in each printing pass, dots formed by another printing pass are not disposed. Hence, the sub-scanning direction resolution of the white image Iw is the same as the nozzle pitch, and the main scanning direction resolution thereof is twice as fine as the highest resolution of the printer 100.

As described above, in the printing mode C8, four printing passes are necessary for printing the unit band BA of the color image Ic, and two printing passes are necessary for printing the unit band BA of the white image Iw. Hence, a total of six printing passes are necessary for printing the unit band BA of the print image PI. Further, the sub-scanning direction resolution of the print image PI in both cases of the color image Ic and the white image Iw is the same as the nozzle pitch. In contrast, the main scanning direction resolution thereof in the case of the color image Ic is twice as fine as the highest resolution of the printer 100, but the main scanning direction resolution thereof in the case of the white image Iw is twice as fine as the highest resolution of the printer 100. Hence, in the printing mode C8, the printing speed is higher than that in the printing mode A8, and the image quality of the white image Iw is lower than that in the printing mode A8.

As described above, also in the printing system 10 of the eighth embodiment, in each printing mode, there is a positional difference, in the sub-scanning direction, between the nozzle group for the first image used to form the color image Ic and the nozzle group for the second image used to form the white image Iw at least a part of which overlaps with the color image Ic. Hence, it is possible to achieve a printing process of concurrently forming the color image Ic and the white image Iw while suppressing an increase in the size of the apparatus. Further, in the printing mode A8 in which the print image quality has priority, the number of nozzles, which constitute the nozzle group for the first image used to form the color image Ic, is equal to the number of nozzles which constitute the nozzle group for the second image used to form the white image Iw. In the printing mode C8 in which the printing speed has priority, the number of nozzles, which constitute the nozzle group for the first image used to form the color image Ic, is larger than the number of nozzles which constitute the nozzle group for the second image used to form the white image Iw. Hence, the printing speed is higher in order of the printing modes C8 and A8, and the image quality of the white image Iw is better in order of the printing modes A8 and C8. Accordingly, in the printing system 10 of the embodiment, for example, in the case where a decrease in printing time is more important than suppressing deterioration in the image quality of the white image Iw, the printing mode C8 is selected. In contrast, in the case where suppressing deterioration in the image quality of the white image Iw is more important than the decrease in printing time, the printing mode A8 is selected. In such a manner, it is possible to achieve a printing process appropriate for the use and purpose thereof. As a result, in the printing system 10 of the eighth embodiment, when performing the printing process of forming two images on a print medium in an overlapping manner, it is possible to achieve a printing process appropriate for the use and purpose thereof while suppressing an increase in the size of the apparatus.

I. Modified Example

In addition, the invention is not limited to the above-mentioned embodiments, and may be modified into various forms without departing from the technical scope of the invention. For example, the following modifications are possible.

I1. Modified Example 1

The above-mentioned embodiments described the printing process of allowing the printing system 10 to form the color image Ic and the white image Iw in an overlapping manner. However, the invention is not limited to the printing process of forming the color image Ic and the white image Iw in an overlapping manner. For example, the invention may employ the general printing processes of forming two images on a print medium in an overlapping manner.

Further, in the above-mentioned embodiments, instead of the nozzle arrays (the nozzle arrays corresponding to cyan, magenta, yellow, and black) constituting the color nozzle arrays Co, the white nozzle array W may be used to form the color image Ic. In addition, instead of the white nozzle array W, the color nozzle arrays Co may be used to form the white image Iw.

I2. Modified Example 2

The configurations of the printing system 10 according to the above-mentioned embodiments are just examples, and thus the configurations of the printing system 10 may be modified into various forms. For example, in the above-mentioned embodiments, the printer 100 performs printing by using five inks. However, the printer 100 may perform printing by using inks of four or less colors or inks of six or more colors.

Further, in the above-mentioned embodiments, the printer driver 300 is included in the PC 200 and the printer 100 receives the commands from the printer driver 300 of the PC 200 to perform printing. However, the printer 100 may have a function the same as that of the printer driver 300, and receive various data and information from the application program AP of the PC 200 so as to perform printing. Otherwise, the printer 100 may further have a function the same as that of the application program AP, and the generation of various data and information and the printing process may be performed in the printer 100.

Further, in the above-mentioned embodiments, the color nozzle arrays Co and the white nozzle array W includes a plurality of nozzles which is arranged linearly in the sub-scanning direction. However, it is not necessary for the plurality of nozzles constituting the nozzle arrays to be arranged linearly, and the nozzles may be arranged in a so-called staggered manner. That is, the description, in which the plurality of nozzles is arranged along the sub-scanning direction, means that the plurality of nozzles is arranged so that the respective positions thereof are different in the sub-scanning direction regardless of the positions of the plurality of nozzles in the main scanning direction.

Further, in the above-mentioned embodiments, a part of the configuration which is implemented by the hardware may be substituted by software; on the contrary, a part of the configuration which is implemented by the software may be substituted by hardware.

In addition, in a case where a part or the whole of the function of the invention is implemented by the software, the software (computer program) may be provided in such a manner that it is stored in a computer-readable recording medium. In the invention, the "computer-readable recording medium" is not limited to a portable recoding medium such as flexible disc or CD-ROM, and includes various internal storage devices, such as RAM and ROM, in a computer, or an external storage device, such as hard disk, fixed to the computer.

I3. Modified Example 3

The above-mentioned embodiments described the printing process of concurrently forming the color image and the toned white image on the transparent film as the print medium and producing a piece of printed matter on which the color image and the toned white image are formed. However, the print medium used for the printing process is not limited to the transparent film. For example, an optional medium such as a semi-transparent film, a paper or fabric may be selected.

I4. Modified Example 4

The printing methods of the respective printing modes according to the above-mentioned embodiments are just examples, and may be modified into various forms. For example, in the above-mentioned embodiments, in the printing mode other than the image quality priority mode, the printing time is reduced by decreasing the number of nozzles, which are used to form the white image Iw so as to lower the image quality of the white image Iw. On the contrary, the printing time may be reduced by decreasing the number of nozzles, which are used to form the color image Ic, so as to lower the image quality of the color image Ic. In this case, the printing-mode specification information MS includes information representing which one of the color image Ic and the white image Iw is an image capable of reducing the number of nozzles used in the formation. In such a manner, it is possible to achieve an appropriate printing process depending on which one of the color image Ic and white image Iw is important in image quality.

Further, in the printing mode other than the image quality priority mode, determination as to which one of the white image Iw and the color image Ic is set as an image of which the image quality will be lowered may be made on the basis of the dot data. For example, as compared with the dot data for forming the color image Ic and the white image Iw, the image quality of an image, which has a small number of ink dots to be formed, may be reduced by decreasing the number of nozzles used. In such a manner, by reducing the image quality of an image which has a small number of ink dots to be formed, it is possible to reduce the printing time. Thus, it is possible to achieve a printing process appropriate for the use and purpose thereof.

Further, in the above-mentioned embodiments, the nozzles, which are not used to form any of the color image Ic and the white image Iw, may be used to form an image (for example, the white image Iw) of which image quality will be lowered. For example, in the printing mode C7 of the seventh embodiment shown in FIG. 24, by using the 28th nozzle, a part of each raster of the white image Iw may be formed through the two printing passes. With such a configuration, it is possible to suppress deterioration in image quality of the white image Iw.

Further, the above-mentioned embodiment, the ratio of the number of nozzles (the number of nozzles which are used to form the white image Iw), which constitute the nozzle group for the second image, to the number of nozzles (the number of nozzles which are used to form the color image Ic), which constitute the nozzle group for the first image, is approximately 1:an integer. However, it is not necessary for the ratio to be 1:an integer. Here, when the ratio is set to be 1:an integer, in the printing process of concurrently forming the color image Ic and the white image Iw, by reducing the number of nozzles unused, it is possible to increase process efficiency.

The entire disclosure of Japanese Patent Application No. 2010-055423, filed Mar. 12, 2010 is expressly incorporated by reference herein.

What is claimed is:

1. A printing apparatus comprising:

a first nozzle array that is formed of a plurality of nozzles arranged along a first direction;

a second nozzle array that is formed of a plurality of nozzles arranged along the first direction;

a moving mechanism that moves the first nozzle array and the second nozzle array relative to a print medium in a second direction intersecting with the first direction;

a transport mechanism that transports the print medium relative to the first nozzle array and the second nozzle array in the first direction; and a control section that forms an image on the print medium by repeating an image formation operation for discharging an ink through the first nozzle array and the second nozzle array and a transport operation for transporting the print medium through the transport mechanism, wherein the second nozzle array corresponds to an ink different from the ink corresponding to the first nozzle array, and is arranged in the second direction relative to the first nozzle array, wherein in the image formation operation, the first nozzle array and the second nozzle array are moved in the second direction, wherein the control section forms a first image and a second image, based on a selected printing mode, wherein the printing mode includes a first printing mode which forms the first image by using only a nozzle group included in the first nozzle array, and forms the second image by using only a nozzle group included in the second nozzle array, wherein the nozzle group included in the first nozzle array is formed of N (N is an integer equal or more than 3) nozzles, the nozzle group included in the second nozzle array is formed of M (M is an integer equal to or more than 2 and less than N) nozzles, and a position of the nozzle group included in the second nozzle array is different from that of nozzle group included in the first nozzle array in the first direction, and a second printing mode which forms the first image by using the nozzle group included in the first nozzle array, and forms the second image by using only the nozzle group included in the second nozzle array, wherein the nozzle group included in the first nozzle array is formed of L (L is an integer equal to or more than 2) nozzles, the nozzle group included in the second nozzle array if formed of L nozzles, and a position of the nozzle group included in the second nozzle array is different from that of nozzle group included in the first nozzle array in the first direction.

2. The printing apparatus according to claim 1, wherein the control section forms the first image and the second image through a plurality of printing modes of which respective ratios of N to M are different from each other.

3. The printing apparatus according to claim 1, wherein the control section allows the number of the image formation operations, which are performed to form an area having a predetermined width in the first direction in the first image, to be larger than the number of the image formation operations which are performed to form the area having the predetermined width in the first direction in the second image.

4. The printing apparatus according to claim 1, wherein the control section allows a print resolution of the first image, which is formed on the print medium, in at least one of the first direction and the second direction to be finer than a print resolution of the second image, which is formed on the print medium, corresponding thereto.

5. The printing apparatus according to claim 1, wherein the control section allows the number of the nozzles, which are used to form one ink dot line along the second direction in the first image, to be larger than the number of the nozzles which are used to form one ink dot line along the second direction in the second image.

6. The printing apparatus according to claim 1, wherein the control section acquires dot data which respectively corresponds to two images and represents ink dots to be formed, forms the first image by using the nozzle group included in the first nozzle array on the basis of the dot data in which the number of the ink dots to be formed is larger, and forms the second image by using the nozzle group included in the second nozzle array on the basis of the dot data in which the number of the ink dots to be formed is smaller.

7. The printing apparatus according to claim 1, wherein the control section forms the second image by using the nozzle group included in the second nozzle array and at least one nozzle, of which a position is different from the positions of the nozzle group included in the first nozzle array and the nozzle group included in the second nozzle array in the first direction, among the nozzles included in the second nozzle array.

8. The printing apparatus according to claim 1, wherein the control section forms the second image by using the nozzle group included in the second nozzle array and a nozzle group of which a position is the same as that of the nozzle group included in the second nozzle array in the first direction among the nozzles included in the first nozzle array.

9. A method of controlling a printing apparatus having a first nozzle array, a second nozzle array, a moving mechanism, and a transport mechanism, the first nozzle array being formed of a plurality of nozzles arranged along a first direction, and the second nozzle array being formed of a plurality of nozzles arranged along the first direction, corresponding to an ink different from the ink corresponding to the first nozzle array, and being arranged in a second direction intersecting with the first direction relative to the first nozzle array, the method comprising:

moving, through the moving mechanism, the first nozzle array and the second nozzle array relative to a print medium in the second direction;

transporting, through the transport mechanism, the print medium relative to the first nozzle array and the second nozzle array in the first direction; and repeating an image formation operation for discharging an ink through the first nozzle array and the second nozzle array and a transport operation for transporting the print medium through the transport mechanism, wherein in the image formation operation, the first nozzle array and the second nozzle array are moved in the second direction, wherein in the repeating of the image formation operation and the transport operation, a first image and a second image are formed, based on a selected printing mode, wherein the printing mode includes a first printing mode which forms the first image by using only a nozzle group included in the first nozzle array, and forms the second image by using only a nozzle group included in the second nozzle array, wherein the nozzle group included in the first nozzle array is formed of N (N is an integer equal to or more than 3) nozzles, the nozzle group included in the second nozzle array is formed of M (M is an integer equal to or more than 2 and less than N) nozzles, and a position of the nozzle group included in the second nozzle array is different from that of nozzle group included in the first nozzle array in the first direction, and a second printing mode which forms the first image by using the nozzle group included in the first nozzle array, and forms the second image by using only the nozzle group included in the second nozzle array, wherein the nozzle group included in the first nozzle array is formed of L (L is an integer equal to or more than 2) nozzles, the nozzle group included in the second nozzle array is formed of L nozzles, and a position of the nozzle group included in the second nozzle array is different from that of nozzle group included in the first nozzle array in the first direction.

10. A tangible recording medium storing a computer program for controlling a printing apparatus having a first nozzle array, a second nozzle array, a moving mechanism, and a transport mechanism, the first nozzle array being formed of a plurality of nozzles arranged along a first direction, and the second nozzle array being formed of a plurality of nozzles arranged along the first direction, corresponding to an ink different from the ink corresponding to the first nozzle array, and being arranged in a second direction intersecting with the first direction relative to the first nozzle array, the recording medium storing the computer program for causing a computer to execute:

a function of moving, through the moving mechanism, the first nozzle array and the second nozzle array relative to a print medium in the second direction;

a function of transporting, through the transport mechanism, the print medium relative to the first nozzle array and the second nozzle array in the first direction; and a function of repeating an image formation operation for discharging an ink through the first nozzle array and the second nozzle array and a transport operation for transporting the print medium through the transport mechanism, wherein in the image formation operation, the first nozzle array and the second nozzle array are moved in the second direction, wherein through the function of repeating the image formation operation and the transport operation, a first image and a second image are formed, based on a selected printing mode, wherein the printing mode includes a first printing mode which forms the first image by using only a nozzle group included in the first nozzle array, and forms the second image by using only a nozzle group included in the second nozzle array, wherein the nozzle group included in the first nozzle array is formed of N (N is an integer equal to or more than 3) nozzles, the nozzle group included in the second nozzle array is formed of M (M is an integer equal to or more than 2 and less than N) nozzles, and a position of the nozzle group included in the second nozzle array is different from that of nozzle group included in the first nozzle array in the first direction, and a second printing mode which forms the first image by using the nozzle group included in the first nozzle array, and forms the second image by using only the nozzle group included in the second nozzle array, wherein the nozzle group included in the first nozzle array is formed of L (L is an integer equal to or more than 2) nozzles, the nozzle group included in the second nozzle array is formed of L nozzles, and a position of the nozzle group included in the second nozzle array is different from that of nozzle group included in the first nozzle array in the first direction.

* * * * *